United States Patent [19]

Bastenhof

[11] 4,226,216

[45] Oct. 7, 1980

[54] METHOD OF QUICK PNEUMATIC BRAKING OF A DIESEL ENGINE

[75] Inventor: Dirk Bastenhof, Eaubonne, France

[73] Assignee: Societe d'Etudes de Machines Thermiques S.E.M.T., Saint Denis, France

[21] Appl. No.: 825,145

[22] Filed: Aug. 16, 1977

[30] Foreign Application Priority Data

Sep. 30, 1976 [FR] France ..... 76 29411

[51] Int. Cl.[2] ..... F01L 13/02; F01L 13/04; F01L 13/06; F02D 9/04

[52] U.S. Cl. ..... 123/41 R; 123/321; 123/179 F; 60/625; 60/631

[58] Field of Search ..... 123/41 R, 97 B, 103 R, 123/179 F; 60/630, 625, 631

[56] References Cited

U.S. PATENT DOCUMENTS

| | | | |
|---|---|---|---|
| 1,349,308 | 8/1920 | Woodcock | 60/631 |
| 1,588,879 | 5/1926 | Englert | 60/631 |
| 2,056,710 | 10/1936 | Caserta | 60/630 |
| 3,664,123 | 5/1972 | Zucca | 60/630 |
| 4,038,825 | 8/1977 | Bastenhof | 60/631 |

*Primary Examiner*—Charles J. Myhre
*Assistant Examiner*—Carl S. Miller
*Attorney, Agent, or Firm*—Kenyon & Kenyon

[57] ABSTRACT

A method of improving the effectiveness of braking a reversible four-stroke V type Diesel engine with an even number of at least ten working cylinders fitted with individual starting valves sequentially fed from an engine-driven rotary pressure air distributor, the method consisting in reducing the duration of pressure air inlet to the distributor for one bank of cylinders with respect to the other bank and optimizing such a shortened duration for each starting valve of one bank of cylinders during the braking step and possibly optimizing that for each starting valve of the other bank of cylinders for the restarting step.

10 Claims, 10 Drawing Figures a
b
PMH1
PMH2
PMH3
PMH4
PMH5
PMH6
PMH7
PMH8
PMH9
PMH10
PMH11
PMH12
PMB1
AM
G
D
20 40 60 80 100 120 140 160° 180°
128,5°
-128,5°
-123,5°
-63,5°
65°
60°
8°
0°
5°

Figure 3:
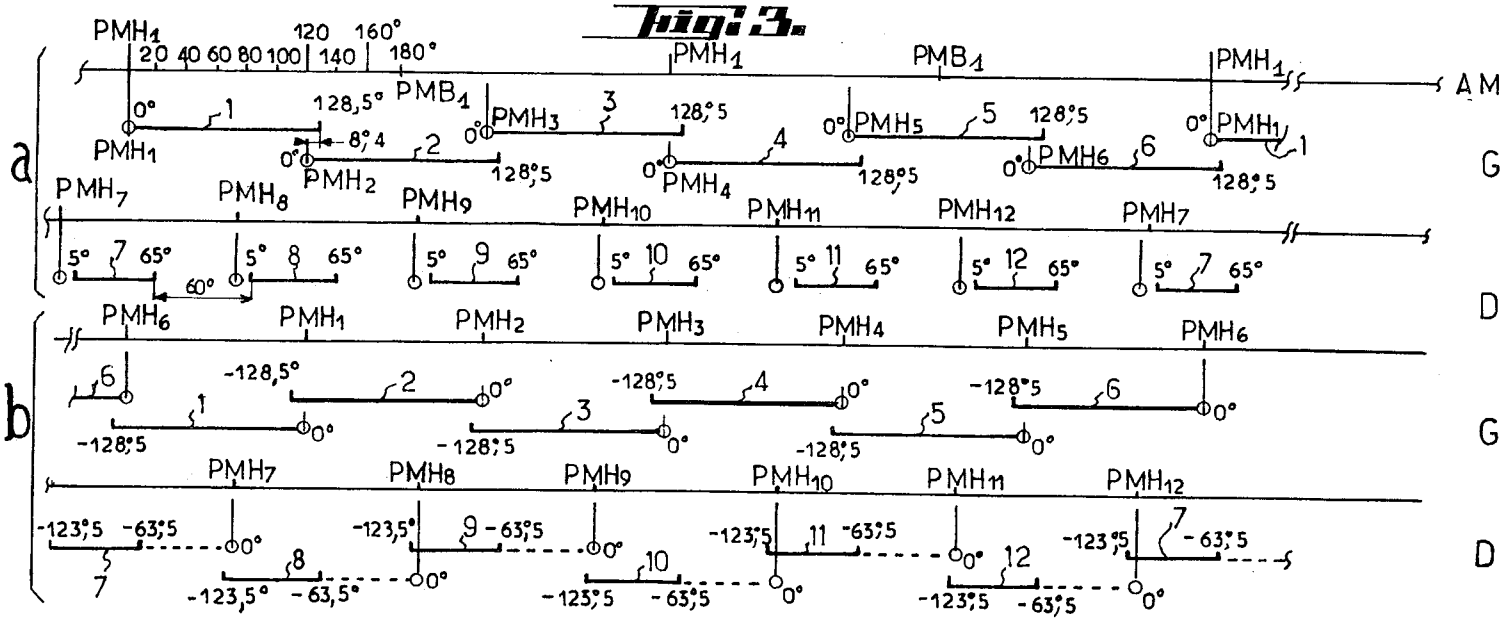

Cf
A
B
C
400
N2
N1
0
r.p.m.

S
So
So'
Sf
Sf'
0
8°
60°
130°
PMH
°AM a
b
AC
AM
G
D
PMH1
PMB1
PMH2
PMH3
PMH4
PMH5
PMH6
PMH7
PMH8
PMH9
PMH10
360°
270°
180°
130°
128,5°
-128,5°
65°
84°
15,6
-63,5°
-123,5°

P
a.
a2
a1
a3
Pa
F1
F2
PMH
PMB
0°
180°
AM
N
100%
97%
68%
58%
52%
50%
40%
31%
24%
16%
12%
0%
b1
b2
b.
b3
b4
b5
F2
F''2
PMH
0°
60°
148°5
PMB
AM
Cf
C
C1
Cm
C2
C3
C4
Co
intake valves are open
0
D1
D2
D3
D4
AM N
100%
48%
40%
28%
24%
12%
0
8%
10%
30%
37%
75%
100%
T
V3
A1, A2
V2
V1
A1
A3
A2
.a.
Cf1
R
B2
B1
Co
4%
72%
.b.
Cf2
.c.
Cf
d1
d2
do
60%
.d.

METHOD OF QUICK PNEUMATIC BRAKING OF A DIESEL ENGINE

The present invention relates generally to the braking, preferably through pneumatic means (or possibly with a gaseous pressure fluid other than compressed air), of an internal combustion engine having a plurality of working cylinders fitted with reciprocating power pistons, respectively, and in particular but not exclusively of a Diesel engine or a like heat engine provided with reciprocating power pistons and operating through fuel injection according to the compression/-spontaneous ignition cycle, for instance such an engine operating on a four-stroke cycle and the direction of rotary motion of which is selectively reversible, as in a marine engine forming part of a propelling power plant aboard a ship, motor boat, sea-going vessel or like mechanically powered floating vehicle or automotive appliance. More specifically, the invention is directed to and has essentially for its subject matter a method of improving the effectiveness of the pneumatic braking of a Diesel engine with a view to achieving a quicker forced slowing-down thereof until its stop from the time of giving the order or issuing the command to stop the engine, possibly with the view to start it again in the opposite direction of rotation. The invention is also concerned with a device for carrying out said method as well as with the various applications and utilizations resulting from performing the process and/or using the device and with the systems, arrangements, appliances, motorized vehicles of any kind, equipments and installations provided with such improved devices.

It is known, for instance, that power driven ships which are propelled by reversible multiple-cylinder marine Diesel engines by means of constant-pitch screw propellers for instance generally exhibit a good maneuverability or handiness but the latter grows worse as the travelling speed and/or inertia of the ship increases. When the fuel supply to the engine is cut off on a big ship while she is under way, for instance at full speed or power, a substantial time will lapse away until the ship stops; so that the distance travelled by the vessel until her stop may sometimes be of several kilometers. In case of danger or emergency, for instance when there is an impending collision or distress hazard or the like, it is necessary to promptly carry out an emergency maneuver with a view to stopping the ship or motor boat rushing ahead at full speed for instance in the forward direction of travel, in as short a time as possible, preferably by means of a prompt reversal of the propulsion engine which therefore requires to be stopped previously so that it is necessary at first to brake or slow down the engine quickly until stop and then to restart same in the opposite direction of rotation. Such an emergency operation may prove to be difficult with an internal combustion engine. Since the ship is still carrying her way or forging ahead (i.e. running forward on account of her momentum), the engine would be driven through the agency of the screw propeller in the direction of a forward run, for instance through the inertia of the ship, so that before reversing the engine and restarting same in the direction of backward travel it is necessary to wait until the remaining rotary speed and the inertia forces have decreased enough. With respect to the working or conduct of the ship it is accordingly desirable, if not necessary, to be able to quickly deaden or slacken the rotary speed of the engine by strongly braking same so as to artificially obtain a large deceleration of the ship in order to deaden, check or stop her headway until the ship is without headway or comes to a stop and then to back up or go astern by beginning to move again in the reverse direction as swiftly or soon as possible. As the propulsion machinery is subjected to the conditions and constraints attaching to the ship working requirements that compel the propelling power plant to undergo large variations in its running speed, a satisfactory manoeuvring capability, that is, the one enabling frequent evolutions or alterations of course associated with the swiftness and the safeness of the ship backing-up or engine reversing operations, would involve the use of an effective braking and restarting system having a high reliability or safeness of operation. For the purpose of pneumatically starting and braking (deadening or slackening the speed of) the engine, at least some working cylinders thereof are provided with individual compressed air inlet or starting valves, respectively, which, with a view to perform a repeated and cyclically intermittent (i.e. periodical but temporary) operation, may receive main starting or braking compressed air and auxiliary control or pilot compressed air (for actuating the starting valves) from at least one preferably rotary central distributor for timing the admission of compressed air to said starting valves in the proper sequence, said distributor being fitted with a distributing member (such as a disc with a trued seating face or slide-spool valves arranged in a star-like fashion or radial configuration and operated by a single common cam) driven by the engine generally in synchronism with a cam-shaft adapted to actuate the intake and exhaust valves, respectively, of the engine or by this shaft proper. The distributing member revolves therefore at the rotary speed of the cam-shaft, and accordingly at one half of the rotary speed of the crankshaft in the case of an engine operating on a four-stroke cycle. In the case of a reversible engine, each cam-shaft thereof may comprise a set of cams for forward running and a set of cams for reverse running, the use of which is interchangeable so that changing over from one set to the other enables the direction of rotation of the engine to be reversed by substituting for instance the action of the reverse-running distribution gear for the action of the forward-running distribution gear. Such a change-over is usually performed by axially shifting each cam-shaft according to a longitudinal translatory motion in either of two opposite directions between two opposite forward-running and reverse-running end positions, respectively. In the case of a rotary distributor provided with a single pilot air inlet port such a shifting of the cams is attended at the same time by a corresponding rotary angular displacement or offset of the distributing member of the distributor, by a suitable fixed angle in the proper direction, for the purpose of starting the engine in the reverse direction. There is no such an angular offset in the case of a rotary distributor provided with a pair of separate pilot air inlet ports for forward-running and reverse-running operations, respectively.

More specifically, in the case of engines with a relatively large number of working cylinders, and in particular with an even number of at least ten working cylinders arranged, for instance in V shape, into a pair of rows or banks of an equal number of working cylinders, it is known in the prior state of the art to use either one of the two following arrangements:

(1) One single row or bank of working cylinders is provided with individual starting valves, with one valve fitted on each cylinder, whereas the other row or bank of working cylinders is devoid of starting valves, so that the pneumatic starting of the engine is effected by feeding compressed air to one row of working cylinders only.

Thus, for instance, with a V-type engine having twelve cylinders arranged in two rows or banks of six working cylinders, respectively, the reduced common value of the successive time periods of pilot air admission at the distributor, for feeding pilot air to the starting valves fitting one single bank of cylinders in order to open said valves, may correspond to a usual angle of rotary travel of the crank-shaft of about 148.5°, the starting valve opening, when starting the engine, being initiated at about 10° (of crank-shaft travel) before the power piston of each working cylinder reaches its top dead centre angular position (there being a mutual overlap of about 28.5° between the time periods of supplying any two successively fed working cylinders with compressed starting air) whereas the other row or bank of working cylinder is devoid of any starting valve.

(2) Both rows of working cylinders are provided with individual starting valves, respectively, each one of which is alternately actuated to open and to close by being pneumatically controlled or operated to open whereas its closing is performed automatically by at least one biasing return spring upon exhausting or venting its pilot air content. In that instance the pneumatically-operated start takes place by feeding compressed air into both rows of working cylinders at the same time, but then there may be the two following situations:

(a) The respective discontinuous durations of opening of the starting valve are the same in both rows of working cylinders and may for instance correspond, in terms of duration of admission of pilot air to the distributor, to an angle of rotary displacement or travel of the crank-shaft at the most equal to 180° (which is the angular distance between the successive top and bottom dead centres of a power piston in a working cylinder).

In that case there would be a relatively large overlap of each inoperative or idle time period between the closing time of each starting valve and the opening time of the next starting valve (following in the normal order of firing or ignition sequence) in a same row of working cylinders by the closing time period of the starting valve of a corresponding working cylinder of the other row of working cylinders; whereas the overlap of each similar time period in the other row of working cylinders by the closing time period of the starting valve of a corresponding or homologous working cylinder of the first named row of working cylinders would be relatively small or short.

Depending upon the magnitude of the opening time period or duration of the starting valves and the number of working cylinders in each row, the successive opening time periods or durations of the starting valves of any two successively air fed working cylinders in a same row may either be spaced (and accordingly separated by an idle or inoperative time period) from or overlap each other (which would mean that the supply of working cylinders with starting compressed air would be initiated before the end of compressed air-supply of the directly preceding working cylinder in their firing order of ignition sequence). For instance in the case of a V-type engine with ten cylinders with a duration of admission of pilot air to the distributor (for opening the starting valves) corresponding to an angle of about 148.5° of rotary travel of the crank-shaft, such an overlap would correspond to an angle of rotation of about 4.5° of rotary crank-shaft displacement.

In this connection, when considering the graphic chart showing the variation of the displacement of a power piston in a working cylinder of an engine operating on a four-stroke cycle during its alternating upward and downward strokes, respectively, as plotted against the corresponding angle of rotation or rotary travel of the crank-shaft as well as the actual times and respective periods of advanced opening and closure of the intake and exhaust valves, it is found that the best opening time period of each starting valve is during each power or expansion stroke of the operating cycle when starting the engine during the closing period of all distribution (intake and exhaust) valves, said optimum period being initiated at least from the top dead centre of the power piston in the working cylinder and ending preferably before the following bottom dead centre about the time of opening of the exhaust valves, so as to avoid any loss of compressed air escaping through the latter. It results therefrom that the opening of the starting valves during each intake stroke is unfavourable because it takes place while the intake valves are open, thereby resulting in a larger consumption of compressed air, since the latter is lost through these open intake valves.

Likewise the braking step with a view to deadening or slackening the rotary speed of the engine reaches its best effectiveness when each starting valve opens during each compression stroke of the operating cycle during the closing time period of the distribution (intake and exhaust) valves while having its opening so timed as to be initiated about the bottom dead centre of the power piston of the working cylinder and in particular about the time of closing of the exhaust valves (after changeover shift of the cams for reversal of the direction of running) and its closing so timed as to be initiated at least about the top dead centre of said power piston.

In the aforesaid case of a duration of opening at the distributor (i.e. duration of admission of compressed air therethrough of each starting valve during a rotation of the crank-shaft by an angle of 180°, the end terminal portion of the opening time period for starting, which coincides with the portion of initiating the opening time period of the exhaust valves, is less or little effective and therefore less advantageous, on account of the losses of compressed air escaping through these open valves (thereby resulting in a larger consumption of compressed air during starting of the engine).

(b) The durations of discontinuous opening of the starting valves, respectively, in both banks of working cylinders are differing from each other, so that the duration of opening of the starting valves of one bank of working cylinders is shorter than that of the starting valves of the other bank of working cylinders. Both of these different durations of the opening time periods of the starting valves in both rows of working cylinders, respectively, may for instance correspond to angles of rotation (of crank-shaft travel) of 110° on the one hand and of 148.5° or 130° on the other hand at the distributor.

Assuming that the working cylinders of the first row of working cylinders are supplied with compressed air in advance or with a lead with respect to the homologous working cylinders of the second row of working cylinders it has been seen in the previous case of an opening time period, at the distributor, of each starting valve during an angle of rotation of 180° (between two successive top and bottom dead centres, respectively, of an expansion or power stroke during the starting step) of crank-shaft travel, that such a duration of opening at the distributor for each starting valve of the first row of working cylinders is too long needlessly towards the end or about the bottom dead center, since that terminal end portion of the opening time period would coincide with the opening of the exhaust valves, thereby resulting in a loss of compressed air escaping through these open valves.

This inconvenience is removed in the present case of a shortened duration of opening of the starting valves of the first row of working cylinders (said duration of opening being meant to be the duration of admission of compressed air through the distributor).

In that instance the overlap of each time interval between any two successive opening time periods (at the distributor) of two starting valves, respectively, of the row of working cylinders having an angular extent or duration or a length of 110°, by the duration of opening of the corresponding starting valve in the other row of working cylinders is also reduced, owing to that reduced angular duration or length of opening of 110° which would end, upon delivery (by the passage of compressed air flow through the distributor) of the order or command of closing of the starting valve involved, at about 70° before the bottom dead centre, so that said minimally effective terminal end portion of the opening time period is thus eliminated. The duration of opening of the starting valves of the other row of working cylinders may not be shortened to the same extent at the distributor and must accordingly be longer than that of the starting valves in the first row of working cylinders because it is necessary to retain a sufficient overlap of the idle or inoperative time intervals between any two successive opening time periods of the starting valves in said other or second row of working cylinders by the corresponding opening time periods of the starting valves in the first row of working cylinders in order to prevent any discontinuity or lack of drive of the engine.

This known system exhibits the drawback that on large-sized engines the alternating actuation of at least some of the starting valves (and in particular of those provided on working cylinders which are relatively remote or far from said compressed air distributor) for opening and closing same is lagging with respect to the corresponding times or moments of providing and cutting-off the communication between the source of compressed air and said starting valves through the distributing member of said distributor, i.e. with respect to the corresponding moments of admission of compressed pilot air through and of shutting-off said compressed pilot air (with simultaneous venting or exhaust), respectively, by said distributing member. As such an alternating actuation may be likened to or is comparable with respective pneumatic control orders or signals temporarily emitted periodically by the distributor for setting said starting valves under operating pressure and for venting or exhausting same, the aforesaid lag between the moments of emitting such control signals or orders on the one hand at the distributor and the corresponding moments of receiving or carrying out said orders at the starting valves on the other hand, is due to the duration of propagation or conveyance (in view of the relative substantial duration of compressed air pressure rise and drop in each starting valve) of these pneumatic signals within the long connecting pipes or ducts, thereby inducing a delay of transmission between the emission of the pneumatic signals at and from the distributor and their receiving at the remotest starting valves (located farthest away from the distributor). Such a time-delay is awkward and troublesome during the pneumatic braking period of the engine because it increases with that magnitude of rotary speed of the engine at which the pneumatic braking is initiated (or in other words the higher said rotary speed value, the longer said delay). The delay in the opening of each starting valve with respect to the corresponding moment of admitting compressed pilot (or starting valve operating) air through the distributor is conditioned by the velocity of propagation of the pressure wave or surge in the air and by the duration of filling of the starting valve actuator (generally of the ram or piston-cylinder type) with air; such a delay is relatively short and little troublesome at any rotary speed of the engine. The delay in the closing of each starting valve is much longer than that in the opening thereof because the air pressure drop within the starting valve actuator throughout the whole connecting pipe-lines is slower. This delay in closing is an increasing function of the rotary speed of the engine, and the earlier the pneumatic braking step is initiated from the moment where the order to stop the engine has been delivered, the quicker the increase in said delay. The inconvenience of such a delay in closing is that each starting valve may remain open beyond the top dead center of the power piston of the working cylinder involved, thus keeping admitting compressed air into said working cylinder during the expansion or power stroke when the piston starts to move downwards again while, generating power or mechanical energy which may be higher than the braking work, thereby entailing a risk of accelerating the engine again in the same direction while thus opposing or withstanding the directly previous braking effect. Therefore, the lower the rotary speed of the engine, the smaller said delay in closing and the better the braking effect. By way of illustration, with a rotary speed of the engine of 400 r.p.m. or 300 r.p.m., for instance, the delay in closing would result in an accelerating action; whereas with a rotary speed of the engine of 50 r.p.m., for instance, each starting valve would close a little time or shortly before the top dead center, which is satisfactory. Such a risk of reversal of the direction of the torque (which instead of remaining a braking torque becomes a power or driving torque) may accordingly be avoided in said known system only by initiating the pneumatic braking of the engine from a relatively low rotary speed (of 50 r.p.m. for instance) thereof. This means waiting until the engine has slowed down to that low speed in a natural way; so that the pneumatic braking process loses much of its advantage, owing to the relatively substantial increase in the duration of the slowing down period of the engine until its stop.

Referring to ship propulsion, in particular with a marine Diesel engine, from the moment the order to stop is given (by shutting off the fuel injection into the working cylinders) and assuming that no artificial braking is used, the engine would at first decelerate rather quickly through a natural slowing down process (owing to passive resistances such as drag or water resistance to the revolving of the screw propeller, frictional resistance and so on) down to a rotary speed, for instance, equal to 40% of the normal operating speed while keeping driving the screw propeller and then would decelerate more slowly since the engine is then itself driven by the screw propeller, which is rotated by the reaction of the relative water flow or stream in the same direction on account of the advancing motion of the ship carrying her way or forging ahead. Pneumatic braking may be initiated at a time which depends on the effective braking torque available at the rotary speed of the engine at that moment. This available braking torque should at least be equal to the minimum effective or operative braking torque and would exist only from and below a rotary speed equal to about 25% of said normal or rated rotary speed.

The main object of the present invention is therefore to overcome the aforesaid inconveniences and difficulties by providing a new method of a swifter pneumatic braking of a reversible Diesel engine operating in particular on the four-stroke cycle, with an even number of at least ten working cylinders disposed in particular according to a V-shaped arrangement in two rows or banks of a same number of working cylinders, at least some of which in each row are provided with individual starting valves, respectively, the closing of which is automatically operated at least by biasing return spring means after venting of pressure air, and the opening of which is operated through sequential pneumatic control from at least one preferably rotary central distributor driven by said engine, said closing being delayed (or lagging with respect to the moment of delivery of the closing order through shutting off compressed air admission and venting at said distributor) as an increasing function of the spacing distance (or length of the feed pipe-lines) of each starting valve from said distributor, as well as of the instant rotary speed of said engine. This method is of the kind consisting in the step of reducing, through the design of said distributor, the common magnitude of the relative duration, i.e. of the angular length or amplitude (in terms of the corresponding angle of rotation of the crank-shaft) of each respective control signal for opening the starting valves in one row of working cylinders with respect to that of each respective control signal for opening the starting valves in the other row of working cylinders, (thereby decreasing the relative duration of admitting opening-operating compressed pilot air through said distributor for at least one row of working cylinders with respect to the other row), thereby advancing the order for closing by such a lead value that each starting valve involved (i.e. undergoing a shortened opening-control signal) closes, at the latest, about the moment of opening of the or each corresponding exhaust valve on the associated working cylinder, or possibly about the moment when the corresponding piston moves past its bottom dead centre during the starting period of the engine.

The method according to the invention is characterized in that it consists, through a suitable constructional design of said distributor, in at least approximately optimizing the, thus, of the actual relative duration or of the control for opening each starting valve of one row of working cylinders for performing the braking step (with a view to increasing that instantaneous decreasing value of the rotary speed of the engine from which the braking is put into action, thereby advancing the moment of initiating the braking step) and possibly in also optimizing that of each starting valve in the other row of working cylinders for performing the starting step.

According to another characterizing feature of the invention said method consists in determining a useful range of times of effective closing of each starting valve during the braking period in such a manner that this closing takes place before the opening of the distribution (intake or exhaust) valves, respectively, on the corresponding working cylinder, within a range of relative angular positions of the crank-shaft about the top dead centre (between the compression and expansion strokes) of the power piston in the associated working cylinder, which range is defined so as to always generate a positive braking torque or work at least equal to the minimum or least effective torque; whereas the optimum moment of closing, which corresponds to the maximum braking torque, is substantially the time at which the pressure within said working cylinder, upon decreasing during the downward motion of the piston or the expansion stroke, would pass through the value of the available pressure of compressed air.

According to still another characterizing feature of the invention said useful range extends, with respect to that aforesaid row of working cylinders, the actuation of the starting valve of which has been optimized for the braking step, from a rotary speed of the engine equal to about 52% of the rated or normal operating speed, corresponding to the time at which braking is initiated, to a rotary speed of the engine at about 16%, said optimum time corresponding to a rotary speed of about 40%; whereas for the aforesaid other row of working cylinders said range extends from a rotary speed of the engine of about 24% to the zero speed or stop of said engine, said optimum time corresponding then to a rotary speed of the engine of about 12%.

This shows the significant advantage obtained from said features, which result in an outstanding improvement of the braking, performance, since the moment of initiation of braking which in the prior art systems corresponds to a rotary speed of the engine equal to about 24% or 28% of its normal speed, has been advanced so that the braking step is initiated at a substantially earlier time, for instance at a rotary speed of 200 r.p.m. or also in particular at a rotary speed of the engine equal to about 52% of its normal or rated speed.

The substantial improvement provided by the invention consists accordingly in obtaining said required minimum braking torque at a rotary speed of the engine substantially higher than before with a saving or reduction of about 53% in the overall slowing down time (from the delivery of the order to stop until the effective stop and restart in the reverse direction) in comparison with the conventional pneumatic braking, and therefore a corresponding shortening of the path of travel of the ship carrying on her way or forging ahead during that time.

According to another characterizing feature of the invention, for that aforesaid row of working cylinders of which the control of the starting valves is optimized for braking purposes, the relative shortened duration of the periodical passage or flow of compressed air through said distributor represents about 20% to 47% (or even 55%) of the possible usual one corresponding to the other aforesaid row of working cylinders.

The relative duration of passage or flow of compressed air through said distributor, for one aforesaid row of working cylinders, corresponds as known per se to an angle of crankshaft rotation of either normal or usual value of about 148.5° or of a reduced value of about 128.5° or even 110°, whereas the shortened duration in relation to the aforesaid other row of working cylinders is defined so that the period of compressed air admission for each working cylinder of that latter row overlaps the spacing interval or transition region between the respective admission periods for two homologous working cylinders of said other row which are successively supplied with compressed starting air. In that instance, and according to another characterizing feature of the invention, this shortened relative duration corresponds to an angle of crank-shaft rotation of about from 30° to 60° or 1/12th to 1/6th of one crank-shaft revolution.

The invention is also directed by way of new industrial product to a device for carrying out the aforesaid method. In this respect it is already known in the prior state of the art to use at least one distributor of compressed air for pneumatic starting and braking purposes. It is thus possible to provide either one distributor for each row of working cylinders in order to feed or supply all of the starting valves of the associated row of working cylinders, hence a total number of two distributors assigned to both rows of working cylinders, respectively, of the engine or a single distributor to feed or supply all of the starting valves, respectively, of both rows of working cylinders through the same distributor. Each distributor is of the type having a disc forming a rotary distributing member driven by a cam-shaft of said engine, the disc preferably having a seating face with at least one arcuate port forming a compressed air passage-way having substantially the shape of an annular segment or lunule concentric with the axis of rotation of said seating face and successively moving past the preferably identical openings of ducts (provided in the stationary distributor body or stator case housing said distributing rotor member) leading in a proper timing sequence to the individual single-acting pneumatic actuators of all the starting valves (for controlling the opening thereof and which are automatically closed after venting at least by biasing return spring means incorporated thereinto) provided on one aforesaid row of working cylinders, said duct openings having each one a diameter preferably equal to the radial width of said arcuate port and being uniformly distributed (in the firing order of ignition sequence of the working cylinders) and angularly equidistant or equally spaced on and along a circle passing through their respective geometrical centres, which circle is concentric with said axis of rotation and has a radius equal to the mean radius of said arcuate port. In the case of the provision of two separate distributors, with one distributor for each row of working cylinders, the rotating distributing disc of each distributor comprises one single arcuate inlet port only, and the sum of the respective mean curvilinear lengths of said arcuate inlet port and of one aforesaid duct opening subtends an angle of about 74.2° or 64.2° or 55°, for instance; whereas one starting valve is provided on each working cylinder of the other row of working cylinders.

In the case of the provision of a single distributor which is common to both rows of working cylinders of the engine, the rotary distributing disc of the distributor is formed with two concentric arcuate inlet ports, with one port for each row of working cylinders and with the sum of said mean curvilinear lengths of one inlet port and a corresponding duct opening subtending an angle centre of about 74.2° for instance.

The device according to the invention is characterized in that the sum of said mean curvilinear lengths of the arcuate inlet port and corresponding duct opening for one row of working cylinders is shorter than the sum of said mean curvilinear lengths of the inlet arcuate port and corresponding duct opening for the other row of working cylinders and, in particular, subtends an angle of about from 15°, or 1/24th of a revolution, to 30°, or 1/12th of a revolution.

The invention is also applicable when instead of using one central compressed air distributor, use is made of one individual distributor for each working cylinder, for instance of the kind forming a cam-operated slide-spool valve. In such a case the invention brings also about an improvement although the latter is less substantial and also less necessary since the time delay in particular in the closing of the starting valves is less long because of the shorter connecting pipe-lines extending between each individual distributor and its associated starting valve. The use of a central distributor however is more advantageous from an economic standpoint because it involves smaller installation costs (less devices and parts) and in view of the lack of available space for the cams and push-rods at each working cylinder.

The technical problem on which the present invention is based is therefore solved by the latter in a structurally very simple manner allowing an economic manufacture while providing for a reliable and safe operation.

Figure 4:
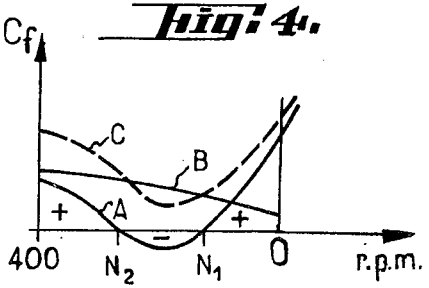
Figure 1:
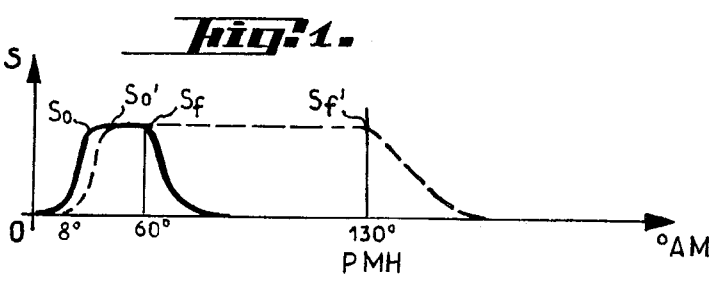
Figure 2:
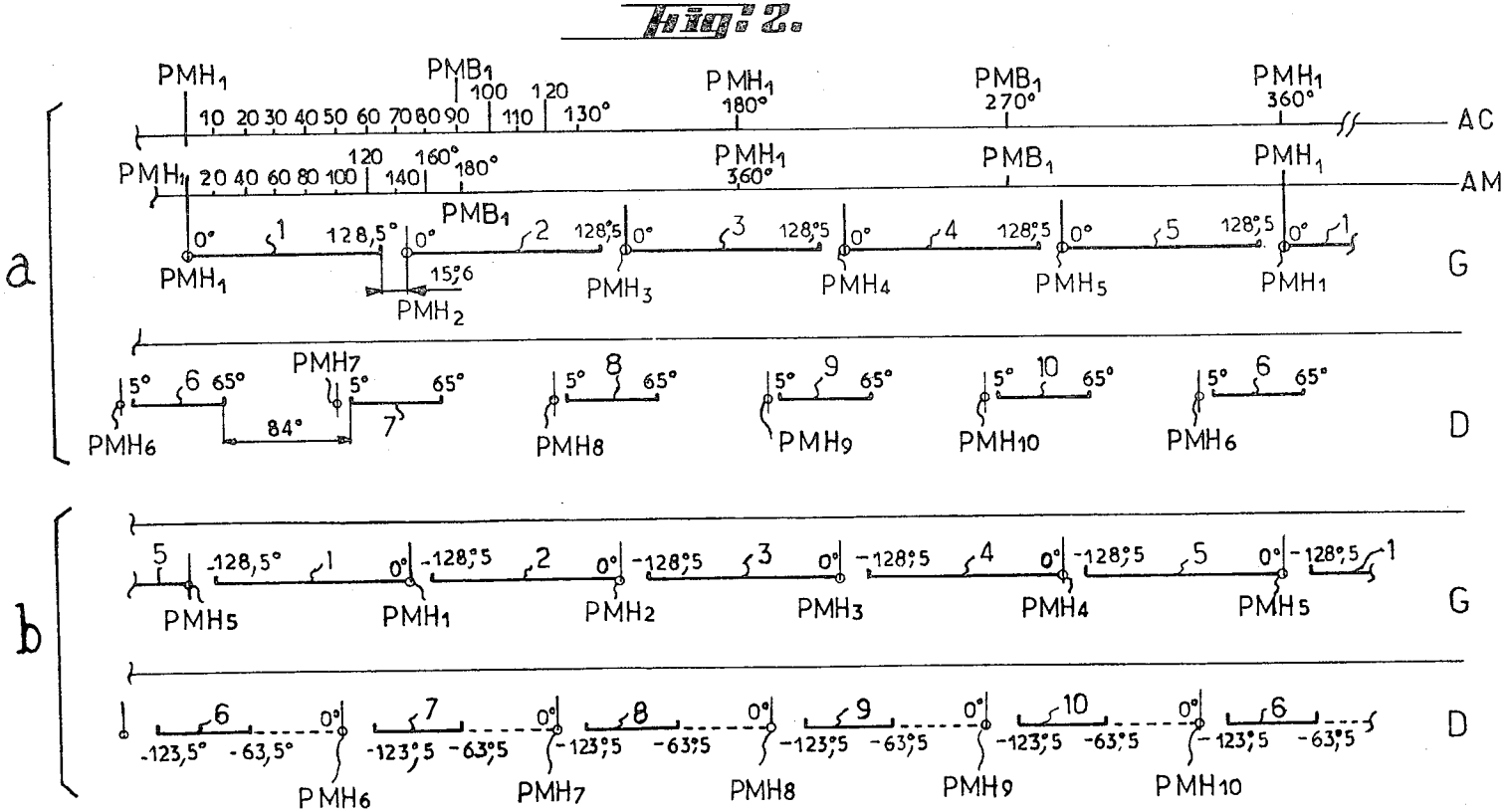
Figure 5:
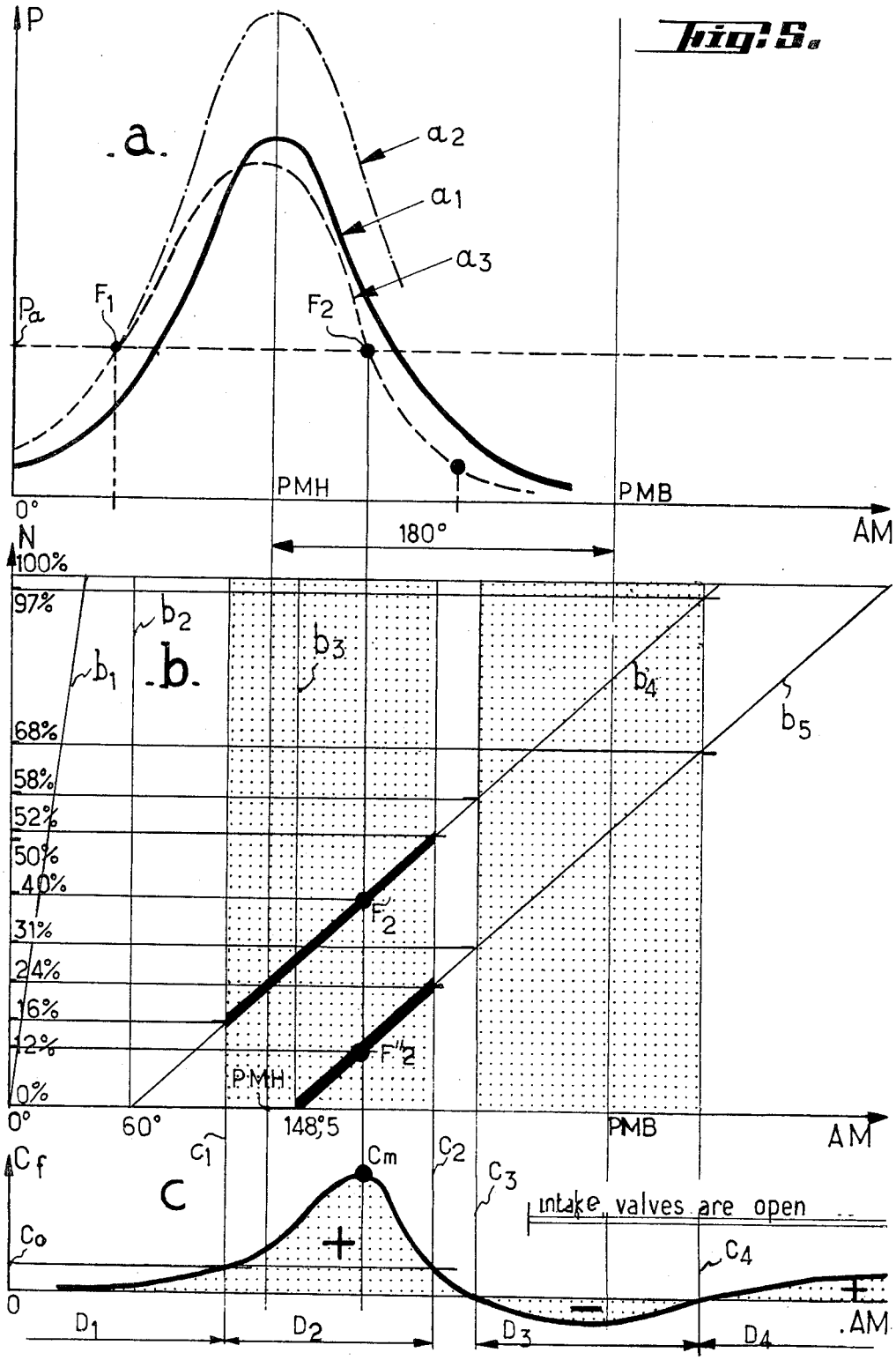
Figure 6:
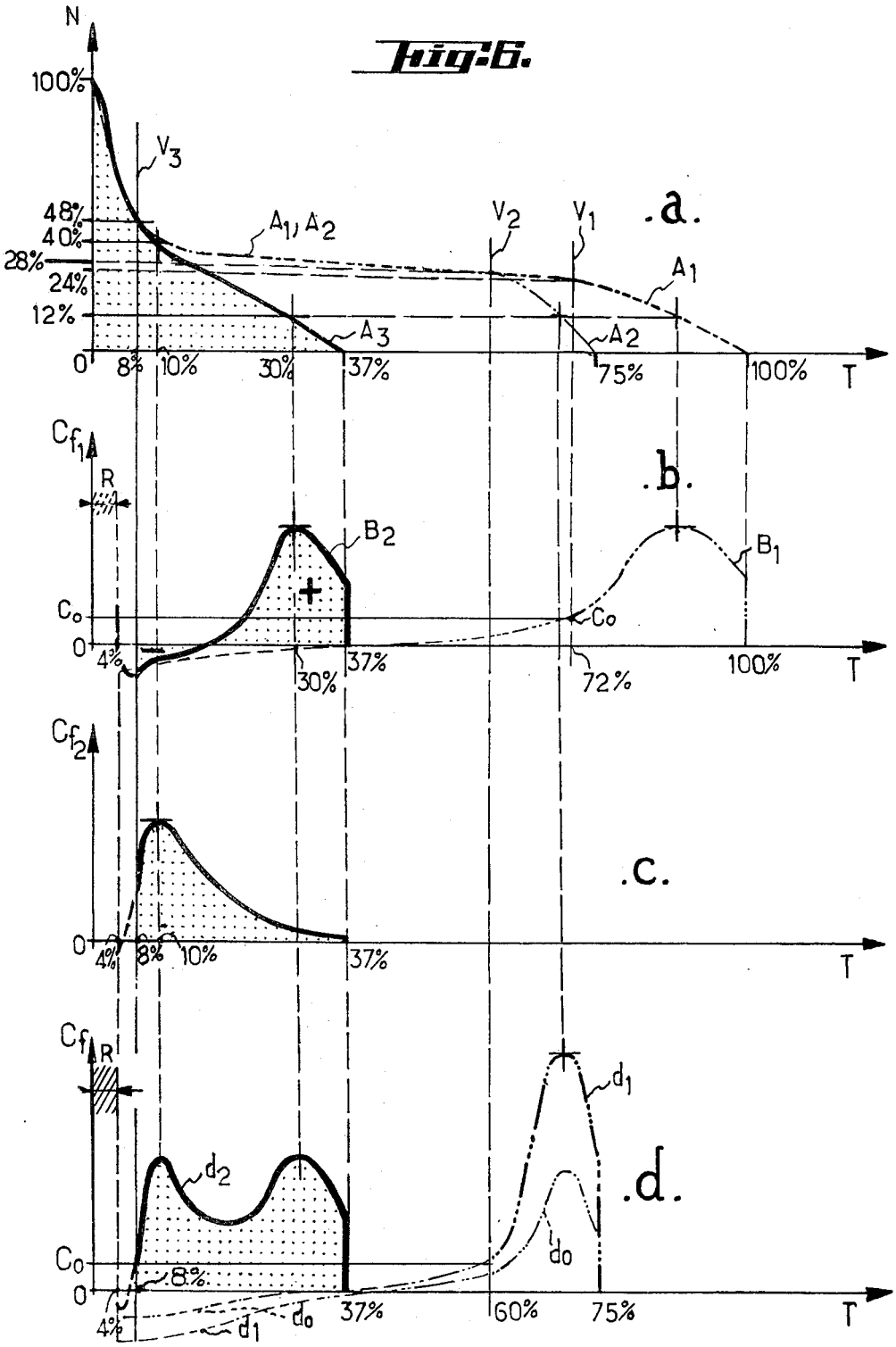
Figure 7:
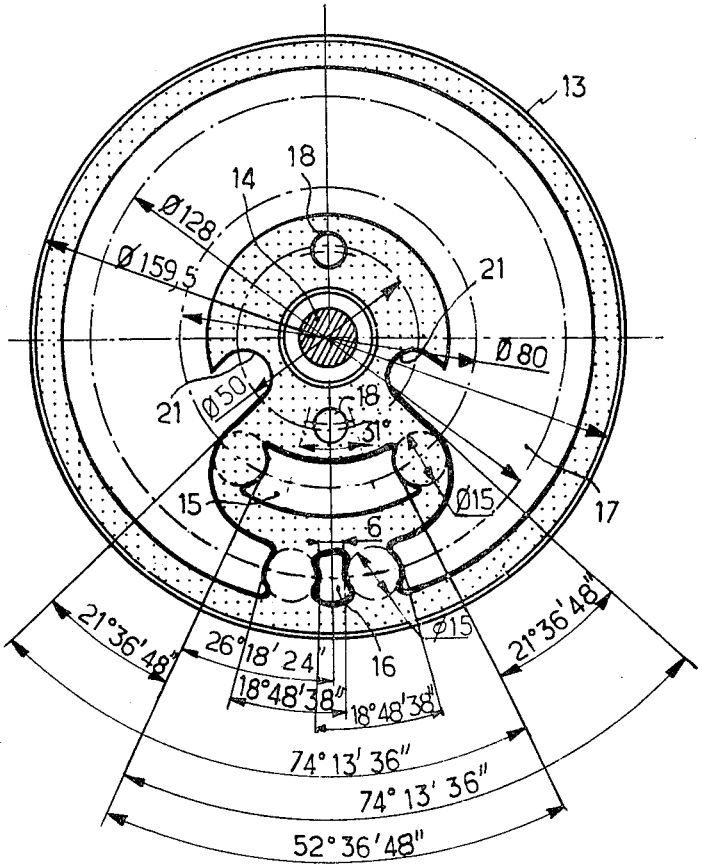
Figure 8:
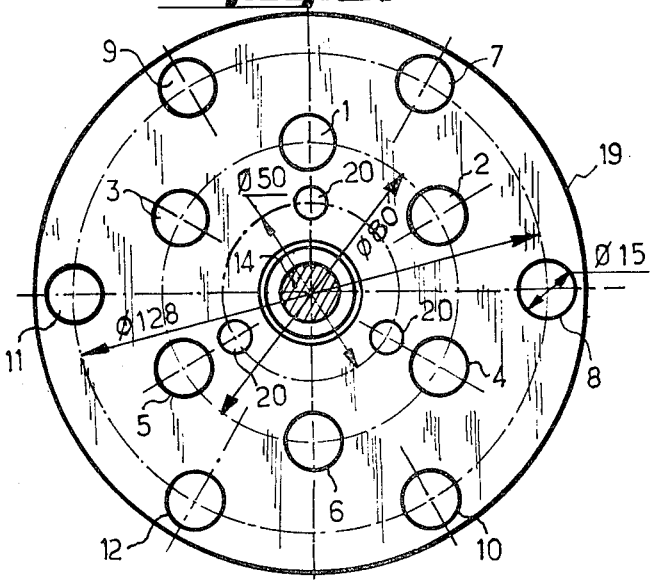
Figure 9:
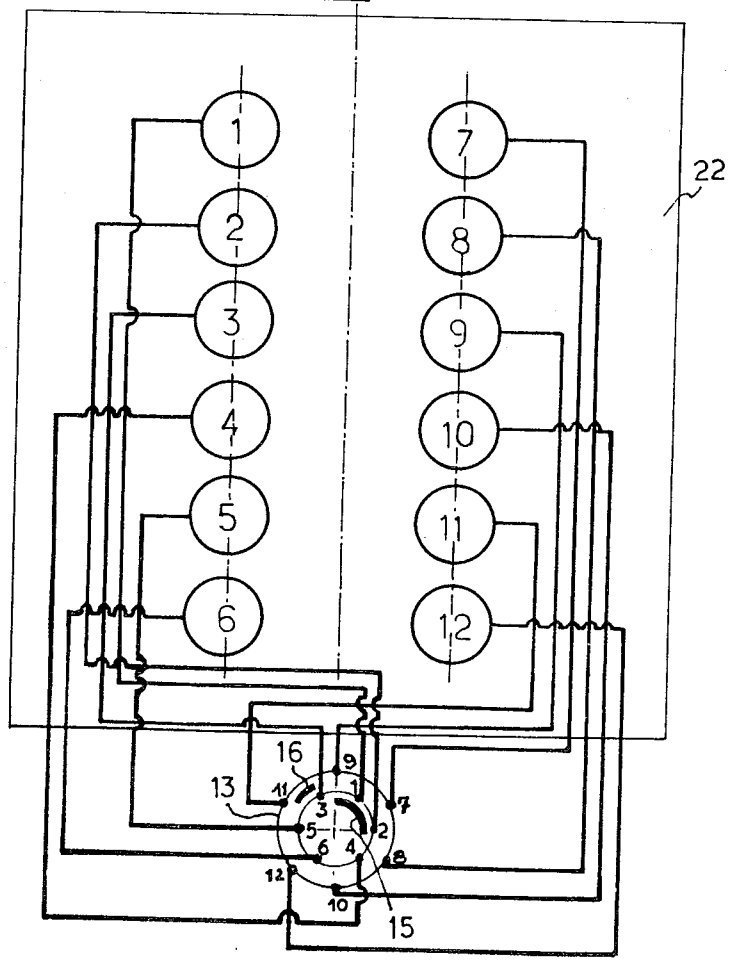
Figure 10:
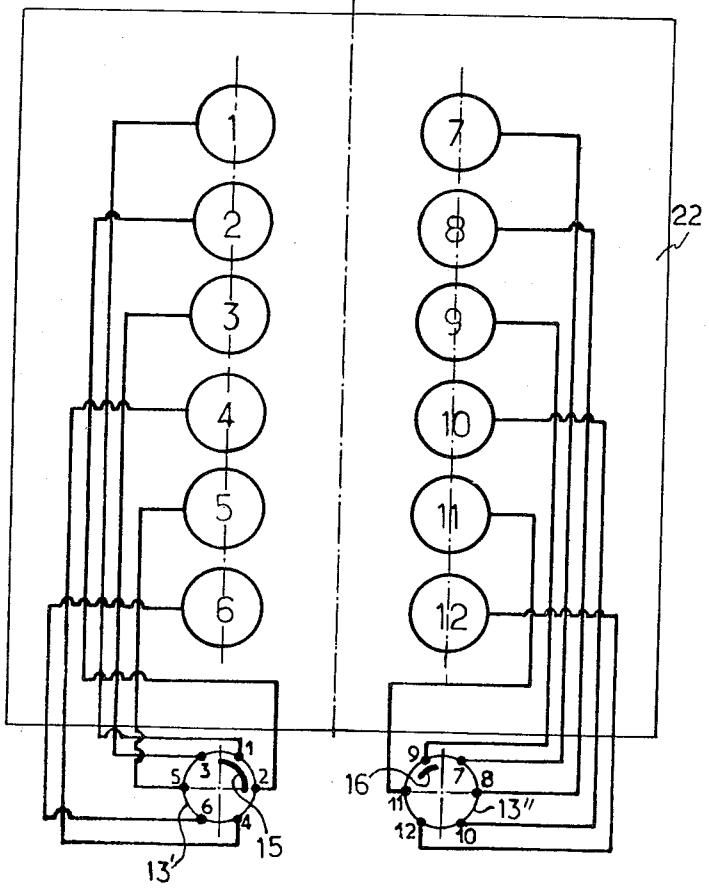

The invention will be better understood and further objects, characterizing features, details and advantages thereof will appear more clearly as the following explanatory description proceeds with reference to the accompanying diagrammatic drawings given by way of non-limiting examples only illustrating various presently preferred specific forms of the embodiment of the invention and wherein:

FIG. 1 is a chart graphically showing the variation in the lifts (plotted in ordinates), namely in the theoretical lift (drawn in solid lines) and in the true lift (drawn in broken lines), of an individual starting valve on a working cylinder against time or against the corresponding angle of crank-shaft rotation (plotted in abscissae) for one starting valve with a shortened duration of opening, actuated in accordance with the method and by a distributor according to the invention;

FIG. 2 is a chart illustrating the application of the principles of the invention to a V-type engine having ten working cylinders arranged in two rows of five working cylinders each, respectively, each working cylinder being fitted with an individual starting valve, and this chart showing on the one hand the differing durations of the order for opening (in terms of the corresponding angles of crank-shaft rotation plotted in abscissae) for the starting valves of both rows of working cylinders, respectively, and on the other hand the relative positions of the respective periods of the orders for opening of the various starting valves in both rows of working cylinders; FIG. 2*a* depicting the case of the starting process whereas FIG. 2*b* relates to the case of the braking process with subsequent reversal of the direction of running and restarting in the reverse direction;

FIG. 3 (*a* and *b*) is a chart similar to that of the previous Figure but applied to a V-type engine having twelve working cylinders arranged in two rows of six working cylinders each;

FIG. 4 is a multiple chart graphically showing the variation in the braking torque (plotted in ordinates) against the angular velocity or rotary speed of the engine (expressed in revolutions per minute and plotted in abscissae) both in the case of the braking by one single row of working cylinders, with a duration of valve opening either of usual or of shortened value (curves drawn in solid lines) for the starting valves of said row, and in the case of the simultaneous braking by both rows of working cylinders in accordance with the invention (discontinuous curve drawn in broken lines);

FIG. 5 shows three charts drawn one above the other in mutual correspondance, illustrating the principles of the invention and wherein, respectively:

FIG. 5*a* graphically shows the variation in the gaseous pressure (plotted in ordinates) prevailing within the variable-volume working chamber of one working cylinder of the engine during an alternating ascending and descending stroke, respectively, of the power piston for two successive compression and expansion strokes, respectively, of its operating cycle between both successive bottom dead centres in the region about the corresponding top dead centre of said power piston separating these two strokes, against the instant relative angular rotational position (expressed in degrees and plotted in abscissae) of the crank-shaft of the engine, in three particular cases defined by three different manners, respectively, of using the individual starting valve of that working cylinder;

FIG. 5*b* graphically shows the variation in the relative angular velocity or rotary speed (plotted in ordinates) of the crank-shaft of the engine as expressed in terms of percentage of the full speed, against the relative angular position of crankshaft rotation (plotted in abscissae) during the successive periods of pneumatic braking of both rows of working cylinders at the same time according to the method of the invention with previous change-over shift of the distribution control cams with a view to reversing the direction of running and subsequent restarting in the reverse direction, and showing the respective time delays of the opening and the closing of the starting valves, thereby determining the respective favourable and unfavourable ranges of pneumatic braking substantially during an operating cycle of one working cylinder of the engine at least partially in correspondence with FIG. 5*a*; and FIG. 5*c* graphically shows, in correspondence with both foregoing partial Figures, the evolution or trend and the direction or sign of the braking torque (plotted in ordinates) generated during the aforesaid corresponding portion of one operating cycle of one working cylinder by each row of working cylinders in accordance with the invention, against the relative angular position of crank-shaft rotation (plotted in abscissae), thereby showing the respective favourable and unfavourable braking ranges;

FIG. 6 is a multiple chart showing a comparison between the performance of a pneumatic braking according to the invention and that obtained in both prior art cases using the braking by one single row of working cylinders and by both rows of cylinders at a time, respectively, and wherein:

FIG. 6*a* graphically shows the variation in the angular velocity of relative rotation of the crank-shaft of the engine as expressed as a percentage of its normal or rated rotary speed (and plotted in ordinates) against time (plotted in abscissae) during the period of natural slowing-down and of pneumatic braking from the moment of carrying out the order of stop until the complete stop of the engine, with previous change-over shift of the distribution control cams for purposes of reversal of the direction of running with a view to subsequently restarting in the reverse direction, in the three aforesaid old and new cases, respectively;

FIG. 6*b* graphically shows the variation in the braking torque (plotted in ordinates) generated during the pneumatic braking by one single row of working cylinders with a usual duration of openings of the starting valves of the latter, against time (plotted in abscissae) in both old and new cases, respectively;

FIG. 6*c* depicts the evolution or trend of the braking torque (plotted in ordinates) generated by the other row of working cylinders having a shortened duration of opening of the starting valves according to the invention, against time (plotted in abscissae);

FIG. 6*d* graphically shows the evolution or trend of the resulting or cumulative braking torque (plotted in ordinates) generated at the same time by both rows of working cylinders, against time (plotted in abscissae) in both old and new cases, respectively;

FIG. 7 is an elevational detail view, from the side of the seating face (for rotary fluid-tight sliding contact or engagement), of the rotating disc of a single compressed air distributor for pneumatic starting and braking purposes according to the invention, adapted to feed both rows of working cylinders of the engine at the same time with durations of opening of the starting valves respectively equal to the usual or conventional normal value for one row of working cylinders, corresponding to an angle of rotation of about 74.2° of cam-shaft travel, and to the shortened value for the other row of working cylinders, which corresponds to an angle of rotation of about 19° of cam-shaft travel;

FIG. 8 is a similar view of the complementary or mating mirror-like polished face of the stationary body or stator case of said distributor for a V-type engine with twelve working cylinders arranged in two rows of six working cylinders each and engageable in bearing relationship by the seating face shown in the preceding Figure;

FIG. 9 is a diagrammatic top view of a V-type engine with twelve working cylinders arranged in two rows of six working cylinders each and wherein each working cylinder is fitted with an individual starting valve, this Figure showing the feeding of the starting valves of both rows of working cylinders, respectively, with compressed air through one single distributor the respective co-operating rotor and stator seating faces of which are similar to those shown in FIGS. 7 and 8, respectively; and FIG. 10 is a view similar to the foregoing one but showing an alternative embodiment wherein all of the starting valves of both rows of working cylinders are supplied with compressed air through two distributors, at which the durations of opening of the starting valves are normal for the left-hand row of working cylinders and are shortened according to the invention for the right-hand row of working cylinders, the rotor seating face of each distributor then comprising one single compressed air passage-way or port having a length matching the associated duration of opening.

With reference to the drawings, FIG. 1 illustrates the effect, in the case of the pneumatic braking, of a shortened duration of opening of one starting valve in accordance with the invention. The continuous curve drawn in solid lines shows the trend or evolution of the theoretical or ideal lift motion S of the starting valve with the assumption that there is no time delay in the transmission of the pneumatic opening and closing control signals, respectively, emitted from the compressed air distributor between the latter and the starting valve involved, i.e. in the case where such signals are transmitted instantaneously, so that the curve drawn in solid lines corresponds to the total duration of opening at or passage of compressed air flow through the distributor. The discontinuous curve drawn in broken lines shows the actual or true trend of the lifting motion of the starting valve when taking into account the time delay of transmission, and at least this latter curve would vary, on the one hand with the duration of opening at or passage of compressed air flow through the distributor and, on the other hand with the instant rotary speed of the engine. The exemplary embodiment shown has been drawn for a shortened duration of opening at the distributor corresponding to an angle of rotation of about 60° of the crank-shaft AM and for an instantaneous rotary speed of the engine, for instance equal to 24%; such that the true or actual moment $S_f'$ of initiation of closing of the starting valve coincides substantially with the time of passage of the power piston of the associated working cylinder through its top dead centre PMH. On both curves, the respective plateaus show the full opening of the starting valve, and it is seen that the time delay in the opening is relatively small, for instance about 8° between the theoretical full opening $S_O$ (at the distributor) and the true or actual full opening $S_O'$ at the starting valve; whereas the time delay of the closing is relatively large, for instance about 70° (meaning that the order has been delivered at 70° before the top dead centre PMH) between the time $S_f$ of theoretical closing at the distributor and the time $S_f'$ of true or actual closing at the starting valve.

As stated herein above, in the existing or known distributors the usual duration of the opening at the distributor corresponds to an angle of rotation of about 148.5° of crank-shaft travel for a V-type engine having at least ten working cylinders. It is possible to reduce by at least 20° this duration of opening which would then change from 148.5° to 128.5° in one row of working cylinders, for instance in the left-hand row of working cylinders which row would be optimized for starting purposes according to the invention and to use, for the other or righthand row of working cylinders optimized for braking purposes according to the invention, a short duration of opening, in spite of the fact that in the left-hand row of working cylinders and in view of the duration of opening, at the distributor, of each starting valve being shortened down to 128.5°, there is an inoperative or idle time interval between the successive opening periods or the starting valves, respectively, of two working cylinders of that row successively fed with compressed air in the firing order of ignition sequence; such an idle or inoperative time interval separates the time of closing of the starting valve of a working cylinder from the time of opening of the starting valve of the working cylinder which is the next to be fed in the firing order of ignition sequence. Such a possibility may be accounted for by the fact that in spite of the short duration of each opening period of the starting valves, respectively, for the right-hand row of working cylinders, each opening period overlaps the corresponding homologous inoperative or idle time period of the left-hand row of working cylinders; so that there is no discontinuity in the resulting starting or braking torque of the engine, which is thus generated continuously. Such a possibility however occurs only on condition that the duration of opening of each starting valve of the right-hand row of working cylinders, which is optimized for braking purposes, corresponds to an angle of rotation of about 60° of crank-shaft travel, and this is not quite optimum for the braking step, and also on condition that each working cylinder of this right-hand row of working cylinders be provided with a starting valve in order to take advantage of the relative angular or time position of the opening period of each starting valve in the right-hand row of working cylinders, which is optimized for braking purposes, with respect to the angular position of the top dead centre of the power piston in the associated working cylinder, which relative position is very advantageous owing to the favourable circumstance providing for an optimum effectiveness during pneumatic start or braking.

FIG. 2 shows the sequence of opening periods for the starting valves in both rows of working cylinders of a V-type engine having ten cylinders arranged in two rows of five working cylinders each numbered 1-2-3-4-5 according to their firing order of ignition sequence for the left-hand row G, for instance, and 6-7-8-9-10 according to their firing order of ignition sequence for the right-hand row D of working cylinders. According to the invention, the duration of opening of the starting valves in the left-hand row G of working cylinders 1-2-3-4-5 is optimized for starting purposes; whereas the duration of opening of the starting valves of the right-hand row D of working cylinders 6-7-8-9-10, respectively, is optimized for braking purposes.

In FIG. 2*a* has been shown on the first horizontally extending upper graduation scale AC the successive angular positions (expressed in sexagesimal degrees) of the respective top dead centres $PMH_1$ and bottom dead centres $PBH_1$ of the stroke of the power piston in the first working cylinder 1, bearing the reference number 1, of the left-hand row of working cylinders, respectively identified by the corresponding angular positions of the cam-shaft whereas on the second horizontal upper graduation scale AM are located or marked the successive angular positions (also expressed in sexagesimal degrees) of the respective top and bottom dead centres of the stroke of the same power piston in its working cylinder, identified by the corresponding angular positions of the crank-shaft of the engine. Since the engine operates on a four-stroke cycle, each angular value shown on the first graduation scale AC corresponding to the cam-shaft travel is equal to one half of the corresponding angular value shown on the second graduation scale AM corresponding to the crank-shaft travel, so that each value on that latter graduation scale is twice the homologous value shown in the former graduation scale.

FIG. 2*a* corresponds to the pneumatic starting step. As shown in the drawing the duration of opening, at the distributor i.e. the relative duration of passage of compressed air-flow through the distributor, for each starting valve of the working cylinders 1 to 5, respectively, in the left-hand row of working cylinders corresponds to an angle of crank-shaft rotation of about 128.5° from the angular position of the top dead centre of the stroke of the power piston in the associated working cylinder hence to an angle of rotation of 128.5°/2=64.2° of cam-shaft travel. Since in the stationary body or stator case of the distributor the duct openings feeding the respective starting valves of the five working cylinders of a same row of working cylinders are uniformly distributed circularly with equal angular spacings of 360°/5=72°, the idle or inoperative time interval separating the time at the end of that period of compressed air-flow passage from the time of initiation of the directly subsequent period for the next cylinder in the normal firing order of ignition sequence corresponds to an angle of rotation of the cam-shaft AC of about 72°−64.2°=7.8° hence to an angle of rotation of 7.8°×2=15.6° of crank-shaft travel. In FIG. 2*a* the respective top dead centres for each working cylinder in the left-hand row of working cylinders have been designated by the reference characters PMH provided with a numerical subscript equal to the number of the corresponding working cylinder.

For the right-hand row D of working cylinders 6 to 10 the relative time positions of the periods of opening at or of passage of compressed air-flow through the distributor for the corresponding starting valves are offset by a certain constant angle towards the left side in the drawing so that each one of these periods (for instance the period for the starting valve of the working cylinder 7) overlaps said homologous idle or inoperative time interval between two corresponding periods for two successively fed working cylinders 1 and 2 of the other or left-hand row G of working cylinders. The aforesaid duration for each starting valve in the right-hand row of working cylinders corresponds to an angle of crank-shaft rotation of about 60° starting at about 5° after the angular position of the top dead centre of the corresponding power piston in its working cylinder while thus extending from +5° to +65° and this duration therefore corresponds to an angle of cam-shaft rotation of 60°/2=30°. The idle or inoperative time interval separating each time at the end of one period from the time at the beginning of the directly following period corresponds thus to an angle of cam-shaft rotation of 72°−30°=42° hence to an angle of crank-shaft rotation of 42°×2=84°. It is thus seen that the relative angular or time position of each period of passage of compressed air-flow through the distributor for the working cylinders 6 to 10 of the right-hand row D of working cylinders is very effective or favourable for starting purposes because the time of beginning of each period is located shortly after the top dead center of the power piston in the associated working cylinder.

FIG. 2*b* relates to the step of reversing the direction of running of the engine by previously braking same pneumatically until stop followed by restarting same in the reverse direction. For the purpose of such operating steps it is necessary at first to undertake a change-over shift of the main distribution control cams (for operating the intake and exhaust valves) by means of an axial or lengthwise translatory motion of each cam-shaft (carrying forward run cams and reverse run cams) in the proper direction so as to change for instance from the forward run cams to the reverse run cams in order to make the former inoperative and to put the latter into service. In the case of a distributor of compressed pilot air provided with one single air inlet it is also necessary to previously turn the rotary disc of each compressed air distributor by a proper angle of rotation so as to bring its arcuate compressed air passage-way port (feeding the starting valves) into the proper relative angular position so as to be in aligned registering relationship with or in front of the duct opening feeding one working cylinder the power piston of which is near its top dead center, with such an angular orientation of its associated wrist-pin on the crank-shaft that it is ready to start a descending power stroke in the reverse or backward direction of running. In the known or prior art systems such a previous turning of the distributor disc is generally operated by means of a splined shaft provided with helical splines forming a kind of screw thread engaging a nut made fast with the cam-shaft driving said disc, this splined shaft being axially shifted in its longitudinal direction by the cam-shaft upon said axial displacement of the latter. Owing to the helical splines such an axial shift of the splined shaft causes the latter and accordingly the distributor disc, to rotate by the angular amount and in the direction of rotation desired. The reverse operations are carried out when it is desired to change-over again from the reverse running to the forward running. In the present instance it should be assumed that the rotary distributor disc undergoes an angular shift or offset of about 128.5° upon cam change-over in particular through alteration of the relative position of the associated cam-shaft when reversing the direction of running. It results therefrom that in the case of the pneumatic braking which should be read in the direction from left to right in FIG. 2*b* the time of beginning of each opening control period (with an angular extent of 128.5° of crank-shaft rotation) at the distributor for the starting valves of the left-hand row of working cylinders 1 to 5 will be located at: 0°−128.5°=−128.5° that is at 128.5° before the top dead centre of the power piston in the associated working cylinder whereas the time of termination of that period coincides with the angular position of said top dead centre in terms of crank-shaft rotary travel. In the right-hand row of working cylinders 6 to 10 the time of outset of each aforesaid period is located at an angle of crank-shaft rotation of: +5°−128.5°=−123.5° and its time of termination is located at an angle of crank-shaft rotation of: +65°−128.5°=−63.5° so that each aforesaid period would begin at 123.5° and end at 63.5° before the angular position of the top dead centre of the associated power piston in its working cylinder. The fact that each aforesaid period begins very early or very long before the corresponding top dead centre is very favourable because it enables the engine to be pneumatically braked effectively. As soon as the engine is thus stopped it is restarted in the reverse direction according to the same operating diagramme shown in FIG. 2*b* which should then be read in the opposite direction from the preceding one, that is from right to left.

FIG. 3 is similar to FIG. 2 but shows the application of the invention to a V-type engine having twelve working cylinders, numbered from 1 to 6 for the left-hand row G of working cylinders optimized for starting purposes, and numbered 7 to 12 for the right-hand row D of working cylinders, optimized for braking purposes. As in the previous case of an engine with ten working cylinders, all of the working cylinders of the engine with twelve working cylinders are provided with starting valves. The fact that in a V-type engine with ten or twelve working cylinders both banks or rows of working cylinders are fitted with starting valves, each cylinder being provided with one starting valve, may be accounted for by the requirement of avoiding any interruption between successive periods of feeding the various working cylinders of a same row with compressed air in their normal firing order of ignition sequence or, in the case where there are no such idle or inoperative time intervals, by the necessity of avoiding an overlap of insufficient or too short an extent (for a proper operation) of the successive air feed periods at the distributor.

As in the examplary embodiment illustrated in the foregoing Figure, FIGS. 3*a* and 3*b* depict the pneumatic starting step and the step of reversing the direction of running with previous pneumatic braking, respectively, and the lengths and relative positions of the opening periods at the distributor for the left-hand row of working cylinders and for the right-hand row of working cylinders, respectively, are equal to the values, respectively, shown in FIG. 2. Thus with regard to the lefthand row G of working cylinders 1 to 6, each period of passage of compressed air-flow through the distributor has a duration corresponding to an angular length or extent of crank-shaft rotation of 128.5° from the angular position of the top dead centre of the associated power piston in its working cylinder, which duration extends after this top dead centre for the starting step and before the top dead centre for the braking step. As to the right-hand row D of working cylinders 7 to 12, each period of opening at or of passage of compressed air-flow through the distributor has a duration equivalent to an angular length or extent of crank-shaft rotation of 60° extending from +5° to +65° after the associated top dead centre for the starting step and from −123.5° to −63.5° before the associated top dead centre for the step of braking and restarting in the reverse direction. It is seen that the aforesaid successive opening periods for the left-hand row of working cylinders 1 to 6 are overlapping each other by a fixed angular amount. Since the inlet duct openings for feeding the respective starting valves of the six working cylinders of a same row of working cylinders are uniformly distributed circumferentially with equal angular spacings of 360°/6=60° in the stationary body or stator case of the distributor, each aforesaid overlap is equal to an angle of cam-shaft rotation of 60°−64.2°=−4.2° or to an angle of crank-shaft rotation of −4.2°×2=−8.4°. With regard to the working cylinders 7 to 12 of the right-hand row of working cylinders there is a constant inoperative or idle time interval between the aforesaid successive periods, the annular length or extent of which corresponds to an angle of cam-shaft rotation of 60°−30°=30° or to an angle of crank-shaft rotation of 30°×2=60° (since a period corresponding to an angular extent of 60° of crank-shaft rotary travel would be equal to an angle of 30° of cam-shaft rotary travel).

In the example illustrated in FIG. 3 it has of course been assumed also that, with a view to reversing the direction of running, the rotary disc of the distributor has undergone an angular shift or offset of about 128.5° upon changing over the cams, in particular through alteration of the relative position of the associated cam-shaft in the proper direction. In view of the mutual overlap of the successive feeding periods available for the left-hand row of working cylinders 1 to 6, it is possible to still further reduce the corresponding shortened feeding periods for the right-hand row of working cylinders 7 to 12 by selecting for said periods an angular value of 40° of crank-shaft rotation (instead of 60°=65°−5° with the examplary embodiment in FIG. 3). In that instance, each shortened period for the right-hand row of working cylinders would extend for instance from 30 25° to +65° after the angular position of the associated top dead centre for the starting step and from −103.5° to −63.5° before said angular position of the top dead center for the step of reversing the direction of running with previous pneumatic braking.

If instead of using an opening period at the distributor reduced to 128.5°, as in the case of FIGS. 2 and 3 it is desired to keep a normal opening period equivalent to an angle of crank-shaft rotation of 148.5° in the left-hand row of working cylinders (which period would thus begin for instance at an angle of crank-shaft rotation of about 10° before the angular position of the associated top dead center) for the starting step, the shortened value of the opening period at the distributor for the right-hand row D of working cylinders is determined only by design or structural requirements, and its minimum or least value is then equivalent to an angle of crank-shaft rotation of about 40°. In such a case with a V-type engine having ten or twelve working cylinders, each opening period at the distributor would extend from −10° (before the top dead centre) to +138.5° (after the top dead center) for the left-hand row G of working cylinders and from +15° to +55° (after the top dead center) for the right-hand row of working cylinders when starting the engine, whereas, when reversing the direction of running with previous pneumatic braking, the corresponding values would be from −10°−128.5°=−138.5° (before the top dead center) to +138.5°−128.5°=+10° (after the top dead center) for the left-hand row of working cylinders, and from +15°−128.5°=−113.5° to +55°−128.5°=−73.5° (before the top dead center) for the right-hand row of working cylinders, still assuming an angular shift or offset of the rotary disc of the distributor equal to 128.5°, for the step of reversing the engine.

With an engine having twelve working cylinders, each opening period at the distributor shortened to 40° for the right-hand row of working cylinders could also extend from +5° to +45° (after the top dead center) for the starting step and from −123.5° to −83.5° (before the top dead center) for the braking step.

In the case of the aforesaid examples with V-type engines having ten or twelve working cylinders according to the invention, experimental work and tests have shown that the consumption of compressed air was not larger than in the case where the opening periods at the distributor for the starting valves of both rows of working cylinders had usual and equal values.

In a V-type engine having fourteen, sixteen or eighteen working cylinders, one single row of working cylinders, for instance the left-hand row of working cylinders, would then be sufficient to provide for the pneumatic start of the engine, so that with regard to the other or right-hand row of working cylinders, which is optimized for pneumatic braking, those cylinders which are remotest or farthest away from the associated compressed air distributor are possibly devoid of starting valves (in view of their air feed piping being too long, which is unfavourable for braking purposes on account of the increase in the time delay of valve closing). Moreover, the shortened duration of opening at the distributor for the starting valves of this right-hand row of working cylinders, optimized for braking purposes, may be reduced to a value corresponding to an angle of crank-shaft rotation of about 40° because this would still provide a mutual overlap of sufficient extent between the opening periods of both rows of working cylinders, respectively.

FIG. 4 illustrates the advantage or technical improvement brought about by the invention, in the case of the pneumatic braking of the engine from a rotary speed of about 400 r.p.m. until its complete stop by showing the variation in the braking torque $C_f$ plotted against the actual or instantaneous rotary speed N of the engine. The continuous curve A drawn in solid lines relates to the pneumatic braking of the engine by one single row of working cylinders, for instance by the left hand row of working cylinders, supplied with compressed air through starting valves controlled by means of a rotary distributor providing for a normal duration of opening at or of passage of compressed air flow through the distributor equivalent to an angle of rotation of about 148.5° for instance of the engine crank-shaft. At the time of stopping the fuel injection into the engine, the latter would revolve at its normal speed of about 500 r.p.m., and from the time of opening the main starting air valve i.e. from the beginning of the period of pneumatic braking by the main compressed starting air, the engie would undergo a braking torque which decreases continuously with an attendent gradual slowing-down of the engine (as its rotary speed decreases) until becoming zero for the rotary speed $N_2$ (lower than the normal or rated rotary speed) and possibly reversing itself by becoming negative (i.e. generating a power accelerating the engine according to the area defined between the curve A and the axis of abscissae and located below the latter). Thus the braking torque when reversing itself becomes an accelerating torque possibly capable of restarting the engine in the same direction of rotation. This phenomenon may still, be enhanced when the engine has many working cylinders, and hence long pipe-lines or ducts connecting the compressed air distributor to the various individual starting valves on the working cylinders, in view of the time delay thus occurring in the feed of these starting valves with compressed air, which delay may be such that the engine instead of being braked is on the contrary driven by the main compressed starting air in the same direction of rotation as before. If such a restart in the initial direction does not take place, the engine keeps slowing down and the negative braking or positive accelerating torque after having increased (its absolute value) up to a maximum value (algebraic minimum on the curve) would decrease until becoming zero for a rotary speed $N_1$ (lower than the rotary speed $N_2$) and reversing itself to become positive again and to begin again to increase (with an increasing braking of the engine).

The curve B on the chart of FIG. 4 depicts the pneumatic braking provided by one single row of working cylinders, for instance the right-hand row of working cylinders, supplied with compressed air by a rotary distributor wherein the duration of opening at or of passage of compressed air-flow through the distributor is shortened according to the invention, corresponding for instance to an angle of crank-shaft rotation of about 40° or 60°. It is seen that the torque generated is always braking or positive and that at the outset of the braking period (at a rotary speed of the engine of about 400 r.p.m.) the braking torque achieved is higher than that obtained with a normal or usual duration of opening at or of passage of compressed air-flow through the distributor according to curve A. As the engine is slowing down, this braking torque (according to the curve B) would decrease with the rotary speed of the engine in a continuous and smooth or regular manner according to a curve decreasing in a monotonic fashion.

The curve C drawn in broken lines represents the cumulative effect, that is the resulting or additive braking torque, produced by the sum of the separate torques generated by both rows of working cylinders, respectively, at the same time according to the curves A and B. This resulting torque is always positive, hence braking, and is larger during the major part of the braking period than either one of the aforesaid separate torques considered separately.

FIG. 5*a* graphically illustrates the variation in the pressure P prevailing within the variable-volume working chamber of a working cylinder of the engine as plotted against the instant angular position of crank-shaft rotation substantially between two successive bottom dead centers PMB of the piston stroke, in particular between two successive compression (ascending) and expansion (descending) strokes, respectively, of the operating cycle. The origin of the abscissae (corresponding to the zero value of the angle of crank-shaft rotation) has been selected arbitrarily as coinciding substantially with the time of beginning of the period of opening at or passage of compressed air-flow through the distributor controlling the individual pneumatic starting valve of said working cylinder. For at least the major part of the illustrated period of the operating cycle, all of the distribution (intake and exhaust) valves are closed.

The continuous solid curve $a_1$ corresponds to the case where the starting valve remains constantly closed during the illustrated period of the operating cycle (hence without any fuel injection or admission of compressed air). This curve exhibits a substantially bell-shaped trend, the highest or culminating point of which is located substantially at the top dead centre of the piston stroke; so that during the period involved the pressure within the working cylinder would increase up to a maximum value reached at that top dead centre and would then decrease.

The straight horizontal line drawn in dashes and having an ordinate value $P_a$ corresponds to the normally available main starting air pressure, which may vary between a maximum value of about 30 bar and a minimum value of about 8 bar, for instance.

The dash-dot curve $a_2$ depicts the case where the starting valve opens right at the beginning of said period involved (that is at least from the origin of the abscissae or the value 0° of the angular position of the crank-shaft) and closes at the point $F_1$ of intersection between the horizontal straight line $P_a$ and the curve $a_2$. It is thus found that at the beginning, the pressure within the working cylinder (without any fuel injection) is higher than that corresponding to the preceding case (curve $a_1$) but lower than the available starting air pressure $P_a$, so that the compressed air would enter or flow into the working cylinder during the ascending piston stroke and begin to pneumatically brake the latter. The pressure would then increase within the working cylinder during the ascending compression stroke of the piston, and the starting valve would close when the pressure within the working cylinder reaches the available starting air pressure $P_a$. After that closing, the pressure keeps increasing within the working cylinder until reaching a maximum value of about 100 bar, for instance at the top dead centre of the piston stroke and then begins to decrease. Assuming that said duration of opening at the distributor is of reduced value according to the invention and that the starting valve closes for a relatively low rotary speed of the engine (that is shortly before the stop of the latter in order to reduce as much as possible the closing time delay), there is always at least one power piston which, at the stop of the engine, is located near its top dead center and before the latter, thereby producing a relatively high air compression. This circumstance promotes the restarting of the engine in the reverse direction of running through expansion of that air compressed to a high pressure (of about 100 bar for instance). It should be pointed out that the work carried out is equivalent to the surface area defined between the curve and the axis of abscissae: that portion of this area which is located at the left side of the vertical line passing through the top dead centre PMH corresponds to a braking work, whereas that portion of this area which is located on the right side of that vertical line of PMH corresponds to an accelerating work. The resulting work during that period is equal to the algebric sum of both of these portions of surface located on either side, respectively, of the vertical line of the top dead center PMH. This resulting work may be accelerating, in particular when the pneumatic braking step starts a little late or when the starting valve closes a little too early, but this is of no serious consequence because the pneumatic braking is then produced by the other row of working cylinders, and at a low speed it is moreover favourable for restarting the engine in the reverse direction of running, as just mentioned hereinabove. It should be pointed out that the available compressed air pressure as a general rule is lower than the maximum compression pressure produced by the power piston in normal operation.

The dashed curve $a_3$ corresponds to the case where the starting valve closes at the point $F_2$, where the pressure prevailing within the working cylinder would go again through the value $P_a$ of the available main starting air pressure during the downward stroke of the piston. It is then found that as soon as the compression pressure within the working cylinder during the upward stroke of the piston has become higher than the available main starting air pressure $P_a$, the direction of flow of compressed air is reversed so that the power piston would force the compressed air back into the compressed air feed line or duct through the open starting valve. It results therefrom that the instantaneous or actual pressure reached at every time on the curve $a_3$ during the upward stroke of the piston is lower than the corresponding pressure on the curve $a_2$ in view of that reversal of the direction of compressed air stream, and the maximum pressure value is reached a little before the position of the top dead center PMH of the power piston and is lower than the corresponding maximum value of the theoretical compression curve $a_1$; so that the curve $a_3$ intersects the curve $a_2$, and the downward extending or right-hand branch of the curve $a_3$ is thus inside of the corresponding branch of the curve $a_1$. Thus, as long as the pressure within the working cylinder remains above the available compressed air pressure $P_a$ (portion of curve $a_3$ located above the horizontal straight line drawn at the ordinate $P_a$), there is an operative effect of pneumatic braking, and the point $F_2$ of intersection between the curve $a_3$ and the horizontal straight line at the ordinate $P_a$ would represent the ultimate or last moment at which the starting valve should close to prevent the compressed air from beginning to enter the working cylinder again during the downward stroke of the piston (as soon as the pressure within the working cylinder has become lower than the available compressed air pressure Pa) and thus from accelerating the engine instead of braking the same. In case of a more delayed or belated closing of the starting valve (i.e. beyond the point $F_2$ or below the horizontal straight line at the ordinate $P_a$) the corresponding branch of the curve will be expanded or shifted or offset towards the right side outside of the curve $a_3$, thereby increasing the surface portion defined between the curve and the axis of abscissae and located on the right side of the vertical line passing through the top dead centre PMH, which thus accounts for the accelerating effect resulting from the work thus produced. If, on the contrary, the starting valve closes before the point $F_2$ on that portion of the curve which is located above the horizontal straight line drawn at the ordinate $P_a$, i.e. for a pressure higher than the available starting air pressure, the branch of curve located after the closing point will be expanded or shifted or offset towards the right side and upwards to be outside of the corresponding part of the curve $a_3$ thereby increasing, on the one hand, the value of the maximum pressure reached within the working cylinder and, on the other hand, that portion of area of the work surface which is located on the right side of the vertical line passing through the top dead centre PMH, thus resulting in a corresponding increase of the accelerating work and in an attendant decrease of the braking effect. The optimum time of closing of the starting valve would therefore correspond to the point $F_2$, which also produces the maximum value of the braking torque as will be shown hereinafter.

In the foregoing statement as well as in the following discussion, assuming that the engine is rotating in the direction of forward running, it has been indicated that before the beginning of the pneumatic braking step, the order for reversing the engine has been delivered, while the latter is still rotating in the direction of forward running, by simultaneously shifting both cam-shafts of both rows of working cylinders, respectively, to change from the forward running cams to the reverse running cams, and such an axial translatory motion has also simultaneously caused the rotary disc of the compressed air distributor to turn by a proper angle (for instance of 128.5° owing to a suitable coupling connection by means of a screw-and-nut arrangement between said disc and its drive shaft).

FIG. 5*b* illustrates the respective angular positions of opening and closing of compressed air passage at the distributor and at the starting valve, respectively, (which angular positions are expressed in terms of the corresponding angles of rotation of the crank-shaft of the engine) plotted against the relative instant rotary speed N of the engine (expressed in terms of its full speed value) and shows the influence of the respective opening and closing time delays or lags of the starting valve due to dynamic phenomena. To give an idea thereof it should be assumed here by way of illustration that with respect to one of both rows of working cylinders of the engine, for instance with respect to the left-hand row optimized for braking purposes, the duration of opening at or of passage of compressed air-flow through the distributor is equivalent to an angle of rotation of about 148.5° of the crank-shaft of the engine; whereas with respect to the other row of working cylinders, namely the righthand row optimized for braking purposes, such a duration corresponds to an angle of rotation of about 60° of the crank-shaft of the engine. The opening times at the distributor are then located on a straight vertical line which in the examplary embodiment shown would coincide with the axis of ordinates ON. The times of delayed or true opening of the starting valve are located on a sloping straight line $b_1$. The closing times at the distributor having a short opening period, for the right-hand row of working cylinders optimized for braking purposes, are located on the vertical straight line $b_2$ having an abscissa of 60°; whereas the closing times at the distributor with a normal opening period, for the left-hand row of working cylinders optimized for starting purposes, are located on the vertical straight line $b_3$ having an abscissa of 148.5°. The true or actual closing times of the starting valves with a short duration of opening of 60° at the distributor for the right-hand row of working cylinders are located on the sloping straight line $b_4$ whereas the true or actual closing times of the starting valves with a normal or usual opening period of 148.5° at the distributor are located on the sloping straight line $b_5$ extending in substantially parallel relation to the straight line $b_4$. It should be pointed out that, in fact, to each working cylinder there would correspond two straight lines proper $b_1$ and $b_4$ of differing slopes (from one cylinder to the other) which slopes would depend on the length of compressed air piping associated with the working cylinder involved, that is, on the more or less remote position of the working cylinder, so that the straight lines $b_1$ and $b_4$ in FIG. **5*b*** represent the average or mean values for each row of working cylinders.

FIG. **5*c* depicts the mean or average braking torque generated by each row of working cylinders as a function of the angular position of the true or actual closing time of the starting valves (as expressed in terms of the angle of crank-shaft rotation). The three FIGS. 5*a*, 5*b* and 5*c* located the one above the other are in mutual correspondence through their abscissae defined by the same vertical lead lines. In FIG. 5*c* has been drawn the horizontal straight line at the ordinate $C_o$ representing the least effective value of the braking torque below which the latter becomes practically inoperative. The area of the surface defined between the curve and the axis of abscissae is positive and corresponds to a braking torque when it is located above the axis of abscissae, and it is negative and corresponds to an accelerating torque when it is located beneath the axis of abscissae. It is found that the braking torque of each row of working cylinders would pass through a maximum value $C_m$ when each starting valve in the row involved closes at the time corresponding to the point $F_2$ defined hereinabove in FIG. 5*a* which point is located beyond or on the right side of the top dead center PMH of the stroke of the associated power piston. The curve of FIG. 5*c*** thus depicts the braking torque generated by a row of working cylinders for each angular closing position of the starting valves of that row.

The following various ranges may thus be defined:

1. The range $D_1$ located on the left-side of or before the vertical straight line $C_1$ passing through the point of intersection of the curve with the horizontal straight line of the minimum braking torque $C_o$, which vertical straight line $C_1$ extends on the left side of or before the top dead centre PMH: this range is not favourable to the braking step because the braking torque is of insufficient magnitude there and because a high pressure is prevailing within each working cylinder. This range corresponds therefore to a closing time of the starting valve lying before or on the left side of the vertical straight line $C_1$.

2. The range $D_2$ defined between both vertical straight lines $C_1$ and $C_2$ passing through both successive points of intersection, respectively, of the curve with the horizontal straight line of minimum braking torque $C_o$. This range extends therefore from a position located on the left side of or before the top dead centre PMH to a position lying on the right side of or after that top dead centre and the magnitude of the braking torque is there at least equal to or higher than the least braking torque $C_o$. This range $D_2$ is therefore especially favourable to the braking step.

3. The range $D_3$ extending between the vertical straight lines $C_3$ and $C_4$ passing through both successive points of intersection, respectively, of the curve with the axis of abscissae, that is, through the points where the torque becomes zero and reverses its direction which are respectively located before, or on the left side of, and after, or on the right side of, the vertical straight line passing through the bottom dead centre PMB. That portion of the curve which is defined by that range is located underneath the axis of abscissae, hence on the side of negative ordinates, so that it represents an accelerating torque. Consequently this range $D_3$ is unfavourable to the braking step.

4. The range $D_4$ extending from and beyond the vertical straight line $C_4$ and where the curve is located again above the axis of abscissae, that is, on the side of the positive ordinates, thereby representing a braking torque. Since according to FIG. **5*c*** this range $D_4$ occurs for a period during which the intake valves (and not the exhaust valves in view of the cam change-over shift) are open, a pneumatic braking effected within that range $D_4$ will offer the inconvenience of a relatively high consumption of compressed air owing to loss or escape of air through the open intake valves, and this would in addition also account for the relatively low magnitude of the braking torque obtained, which scarcely reaches or possibly exceeds by a small amount the admissible minimum braking torque $C_o$.

Referring again to FIG. **5*b*, it is seen that in the examplary embodiment chosen and shown, the range $D_2$ which is favourable to the pneumatic braking step extends on the one hand from a relative rotary speed of about 52% to a relative rotary speed of about 16% of the engine on the straight line $b_4$ for the right-hand row of working cylinders with a short duration (60°) of opening at or of passage of compressed airflow through the distributor, and on the other hand from a relative rotary speed of about 24% to the complete stop of the engine on the sloping straight line $b_5$ for the left-hand row of working cylinders with a normal or usual duration (148.5°) of opening at or of passage of compressed air-flow through the distributor, both of these ranges being illustrated for each row of working cylinders by a heavy or thick segment of a straight line. The maximum torque for the right-hand row of working cylinders with a short duration of opening then corresponds (at the point $F'_2$ on the straight line $b_4$) to a relative rotary speed of about 40% of full speed of the engine whereas in relation to the left-hand row of working cylinders with a normal duration of opening it corresponds (at the point $F''_2$ on the straight line $b_5$) to a relative rotary speed of about 12% of full speed of the engine, the point $F_2$ in FIG. 5*a*, the points $F'_2$ and $F''_2$ in FIG. 5*b* and the point $C_m$ in FIG. 5*c*** being aligned in registering relationship on a same vertical straight line.

On the contrary, the range $D_3$ which is unfavourable to the braking step extends, respectively, on the one hand from a relative rotary speed of about 97% to a relative rotary speed of about 58% of full speed of the engine for the right-hand row of working cylinders with a short duration of opening (on the straight line $b_4$), and on the other hand from a relative rotary speed of about 68% to a relative rotary speed of about 31% of full speed of the engine for the left-hand row of working cylinders with a normal duration of opening at the distributor.

The operation according to the method of the invention is therefore performed in the following manner in order to reverse the engine when assuming that the engine rotates in the direction of forward running:

The operator causes the fuel injection to be discontinued and both cam-shafts to be shifted at the same time in order to change from the forward running cams to the reverse running cams, with an attendant limited rotation of the rotary disc of the distributor, and then he must wait until the engine has slowed down in a natural manner to a rotary speed equal to about 52% of its full speed value. The main starting air valve is then opened in order to supply the or each rotary distributor with compressed air for feeding both rows of working cylinders, respectively, which thereby receive at the same time compressed air for braking purposes. The pneumatic braking by means of the right-hand row of working cylinders optimized for braking purposes (straight line $b_4$) thus takes place within the useful braking range $D_2$ while producing an effective positive braking torque until the engine has slowed down to a rotary speed of about 16%; at the same time the left-hand row of working cylinders (straight line $b_5$) generates a negative or accelerating torque (which is accordingly deducted from the braking torque produced by the right-hand row of working cylinders) within the unfavourable braking range $D_3$ until the rotary speed of the engine has dropped to about 31% at which point the torque reverses its direction to become braking and optimum (within the range $D_2$) from a rotary speed of 24% of the engine until full stop of the latter. In this useful range $D_2$ the respective braking torques of both rows of working cylinders would add to each other to give the total or resulting torque. As soon as the engine has stopped, it is restarted in the reverse direction (i.e. in the backward running direction) and this pneumatic restarting in the opposite direction is carried out mainly by the left-hand row of working cylinders which is optimized for starting purposes, but with the simultaneous assistance of the right-hand row of working cylinders which is optimized for braking purposes and which also contributes to this restarting to a substantial extent as previously shown (because the admission of starting air takes place immediately after the top dead centers of the strokes of the power pistons).

FIGS. *6a* to *6d* show the advantage obtained through the process according to the invention. FIG. *6a* compares two previously known usual cases of pneumatic braking, respectively, with the invention by showing the trend of the relative rotary speed N of the engine (as expressed in terms of its normal or rated speed) as a function of time, the origin of time on the axis is of abscissae coinciding with the moment where the order to stop the engine (i.e. to shut off the fuel injection) is delivered.

The curve $A_1$ is concerned with the case of pneumatic braking by one single row of working cylinders provided with starting valves having a normal or usual duration of opening at the distributor which is equivalent for instance to an angle of crank-shaft rotation of about 148.5°, whereas the other row of working cylinders is devoid of any starting valve. In order to define the time scale on the axis of abscissae, one should conventionally take as the time unit the total or overall duration of slowing down of the engine from the time at which the order to stop is delivered until its complete stop (which duration will be therefore equivalent to a time of 100%). FIG. *6b* shows by means of the curve $B_1$ drawn in chain-dotted lines the corresponding variation in the braking torque and comprises the plot of the horizontal straight line at the ordinate $C_o$ of the admissible minimum braking torque. FIG. *6b* shows that the order for changing over or shifting the distribution cams for reversing the engine is delivered at the same time as the order to stop the engine and said order requires to be carried out in a time of about 4% for instance as shown in the Figure by the hatched or shaded area R. For the duration of this change-over or shift of the distribution control cams the engine has naturally slowed down to a rotary speed of about 68% for instance. If compressed air is caused to be admitted into said braking row of working cylinders from that rotary speed (on i.e. from the time where the change-over of the distribution control cams has been completed) the torque obtained would at first be negative and would therefore tend to accelerate the engine until its rotary speed has decreased to about 32% at the end of the time 44%, at which it would become zero and would be reversed to become positive hence braking while remaining below the required minimum braking torque $C_o$ until it has reached this value after a time of about 72%, at the point of intersection of the curve $B_1$ with the horizontal straight line $C_o$. This point of intersection corresponds to a rotary speed of the engine of about 24%, so that the pneumatic braking step should actually begin from that speed on, that is, from and on the right side of the vertical straight line $V_1$ passing through that point of intersection. The braking torque then increases to go through a maximum value corresponding to a rotary speed of the engine of about 12% (at the end of a time of about 16% after the beginning of the pneumatic braking step) to decrease thereafter until the complete stop of engine (which takes place at the end of a time of about 28% after the outset of the pneumatic braking step), the braking torque being then equal at that time to about twice the required minimum torque $C_o$ before suddenly becoming zero.

Considering in FIG. *6a* that portion of the curve $A_1$ which precedes the outset of the pneumatic braking step (i.e. is located on the left side of the vertical straight line $V_1$) it is seen that from the time of delivery of the order to stop (given with a view to reversing the engine for restarting same in the opposite direction of running) this curve at first exhibits a relatively sharply or steeply downward sloping portion corresponding to the natural slowing-down of the engine until it has reached a rotary speed of about 40%, during which slowing down period the engine keeps driving the screw propeller. That steeply downward sloping portion of the curve is followed by a less steeply downward sloping portion having a relatively smooth downward slope during which, on the contrary, the engine is driven by the screw propeller, as explained hereinbefore.

Some improvement may be obtained by pneumatically braking with both rows of working cylinders at a time, and this case is illustrated by the speed curve $A_2$ in FIG. *6a*, to which correspond the torque curves $d_o$, $d_1$ in FIG. 6*d*. This latter Figure shows that the required minimum braking torque $C_o$ is reached when the engine has slowed down naturally to a rotary speed of about 28% (after a time of about 60% defined by the vertical straight line $V_2$), from which the pneumatic braking step may then be initiated. Each row of working cylinders then provides a braking torque shown by the curve $d_o$ in FIG. 6*d*, so that the resulting braking torque shown by the curve $d_1$ is then equivalent to the sum of the respective braking torques of both rows of working cylinders, that is, to twice the braking torque $d_o$ for one row of working cylinders, if it is assumed that the respective braking torques of both rows of working cylinders are equal to each other. The total maximum braking torque (equal to twice the braking torque of the previous case) then takes place again at a rotary speed of the engine of about 12% (in a time of about 12% after the beginning of the braking step), and the complete stop of the engine is achieved after a time of about 75% (from the time at which the order to stop the engine is delivered), so that the total duration of the natural and forced slowing down, respectively, until the complete stop of the engine is shorter by about 25% than in the foregoing case. It is in particular seen here that in order to pass from a rotary speed of 28% to a rotary speed of 12%, about 25% less time is needed than when passing from a rotary speed of 24% to a rotary speed of 12% in the foregoing case.

The continuous curve $A_3$ drawn in solid lines is derived from the method according to the invention, and to that curve are respectively corresponding: the curve $B_2$ drawn in solid lines in FIG. 6*b* and relating to the braking torque generated by the left-hand row of working cylinders with a normal or usual duration of opening at or of passage of compressed air-flow through the distributor equivalent for instance to an angle of crank-shaft rotation of 148.5°; the single curve drawn in solid lines in FIG. 6*c* showing the braking torque obtained with the right-hand row of working cylinders with a short duration of opening for compressed air passage equivalent for instance to an angle of crank shaft rotation of about 60°; and the curve $d_2$ drawn in solid lines in FIG. 6*d* showing the cumulative or resulting torque produced by both rows of working cylinders and equal to the sum of the respective torques derived from each row of working cylinders (algebric addition of the ordinates of the curve $B_2$ in FIG. 6*b* and of the curve in FIG. 6*c*). The curve $d_2$ in FIG. 6*d* shows that the required minimum braking torque $C_o$ is obtained from and below a rotary speed of the engine of about 48% reached after a time of about 8%, so that the pneumatic braking step may already be initiated from that rotary speed hence from the vertical straight line $V_3$ passing through the point of intersection of the curve $d_2$ in FIG. 6*d* with the horizontal straight line of the required minimum braking torque $C_o$. It appears from FIG. 6*b* that the braking torque of the left-hand row of working cylinders passes through a maximum value after a time of about 30%, corresponding to a rotary speed of the engine of 12%, whereas the curve in FIG. 6*c* shows that the braking torque generated by the right-hand row of working cylinders passes through a maximum value after a time of about 10%, corresponding to a rotary speed of the engine of about 40%. The curve $d_2$ in FIG. 6*d* shows that the cumulative or resulting braking torque passes through two successive maximum values corresponding to the rotary speed of the engine of 40% and 12%, respectively, and separated by an intermediate minimum value. The full stop of the engine is achieved after a time equal to 37% from the moment where the order to stop is delivered, thereby resulting in a substantial improvement or saving respectively obtained through shortening of the time period and through increase in the rotary speed of the engine at which the pneumatic braking step is initiated, which improvement or saving is obtained with respect to both aforesaid known prior art cases corresponding to the discontinuous curves $A_1$ and $A_2$ drawn in chain-dotted lines, respectively, in FIG. 6*a*.

FIG. 7 shows the front side forming the seating face with a mirror-like polish, for rotary fluid-tight sliding contact or engagement, of the rotating disc 13 of a rotary compressed air distributor according to the invention, which is common to both rows of working cylinders of a V-type engine to be simultaneously supplied with compressed air by said single distributor. The grey dotted portions denote the solid parts of this seating face whereas the white portions denote the hollow or depressed parts or the through-holes or recesses opening into that seating face. The disc 13 is operatively rotated generally in synchronism with a cam-shaft of the engine by means of a coaxial rotary shaft 14 directly or indirectly coupled to said cam-shaft. This disc 13 is formed with a pair of concentric arcuate slots 15 and 16 fully extending through the disc in parallel relation to its geometric axis of rotation 14 and which have each one approximately the shape of a lunule with circumferentially opposite ends, which are each one concave and rounded according to an arc of circumference having a radius substantially equal to the constant radius of each one of stationary duct openings for feeding the working cylinders, the slots 15 and 16 moving successively past said duct openings during the rotary motion of the disc. The concave shape of said ends of each slot provide for a more straightforward opening and closing of compessed air passage-way by one aforesaid stationary duct opening when the slot involved is moving past the latter. The radially inner port or slot 15 is adapted to feed the left-hand row of working cylinders and provides a duration of opening of compressed air passage-way through the distributor of normal or usual value, that is corresponding here to an angle of crank-shaft rotation for instance of 148° 27′ 12″; whereas the radially outer port or slot 16 is adapted to feed the right-hand row of working cylinders and provides a shortened duration of opening of compressed air passageway corresponding to an angle of crank-shaft rotation for instance of 37° 37′ 36″; accordingly, the duration of opening of the compressed air passage-way for the left-hand row of working cylinders is determined by the sum of the respective mean circumferential curvilinear lengths of the port 15 and a stationary cylinder feed duct opening (illustrated by circular holes drawn in broken lines in FIG. 7) and subtending an angle of 74° 13′36″ (which is an angle of rotary travel of the cam-shaft 14 equal to one half of the aforesaid angle of crank-shaft rotation of 148° 27′ 12″). Likewise, the radially outer port or slot 16 for feeding the right-hand row of working cylinders having a short duration of opening of compressed air passage-way, provides circumference of compressed air inlet through a total arc which subtends an angle of 18° 48′ 38″ (angle of rotary travel of the cam-shaft 14 which is equal to half the angle of crank-shaft rotation of 37° 37′ 36″).

By way of illustration, the radially inner port 15 and the six respective stationary duct openings for feeding the left-hand row of working cylinders are respectively centred on a circle with a diameter of 80 mm, whereas the radially outer port 16 and the stationary duct openings for feeding the right-hand row of working cylinders are respectively centred on a circle having a diameter of 128 mm, the least inner circumferential width of the port 16 being for instance about 6 mm. Each stationary cylinder feed duct opening has a diameter for instance of 15 mm, which orresponds to the radial width of each one of the ports 15 and 16. The holes with a diameter of 15 mm drawn in broken lines in FIG. 7 show the respective position of a stationary cylinder feed duct opening at the position where it begins to be uncovered by the port 15 or 16 in one direction of rotation of the disc 13 or at the position where it completes being covered or closed in the reverse direction of rotation of this disc. Instead of an angle at the centre of 74° 13′ 36″ (or about 74.2°) corresponding to the duration of opening or uncovering of a duct opening by the radially inner port 15, it is also possible to provide for instance an angle value of about 64.2° or about 55° (corresponding respectively to angles of crank-shaft rotation of about 128.5° and about 110°), whereas instead of an angle of 18° 48′ 38″ (or of about 19°) corresponding to the duration of opening or uncovering by the radially outer port 16 it is also possible to provide an angular value for instance of about 30° or of about 20° (corresponding to angles of crank-shaft rotation of about 60° and of about 40°, respectively).

The aforesaid front side or face of the disc 13 is also recessed or hollowed out to form an arcuate groove 17 having a solid axial bottom or end wall, which groove opens into the front seating face and is substantially symmetrical with respect to the diametral axis extending through the centres of the ports 15 and 16. This recess 17 has such a size and shape that when a stationary cylinder feed duct opening of either row of working cylinders communicates with the radially inner port 15 or with the radially outer port 16, the stationary duct openings for feeding those of the other working cylinders, which have to be vented or exhausted to the open atmosphere, are aligned in registering relationship with the recess 17 by being located in front or opposite thereof. Through the disc 13 moreover extends, for instance, a pair of diametically opposite bores 18 which are adapted to discharge or drain away the compressed air leakages escaping between the mutually engaging contact surfaces of the rotor disc 13 and of the stator or stationary body, respectively, of the distributor and to equalize or balance the air pressures exerted upon both axially opposite side faces of the disc 13. FIG. 8 shows the complementary or mating engaging face of the stator or stationary body or case 19 of the distributor against which the disc 13 is adapted to bear with a sliding contact in sealing relationship. That stator face has also a mirror-like polish and into that face are respectively leading or opening the twelve holes or duct openings for feeding compressed air to the twelve cylinders, respectively, of both rows of six working cylinders of the engine, these holes having each one a constant diameter of for instance 15 mm. To the left-hand row of six working cylinders numbered 1 to 6, respectively, are corresponding the six feed duct openings 1 to 6, respectively, the respective centres of which are uniformly distributed in equally angularly spaced relationship on a radially inner circle having the same diameter of 80 mm as the middle arc of circumference of the radially inner port 15 of the rotary disc 13. Likewise, the six holes 7 to 12 for feeding the six working cylinders 7 to 12, respectively, of the right-hand row of working cylinders have their respective centres uniformly distributed in equally angularly spaced relationship on a radially outer circumference having a diameter of 128 mm equal to that of the middle arc of circumference of the radially outer port 16 of the disc 13. In each one of both circular rows of six holes each, the holes are successively arranged or follow each other in the firing order of ignition sequence of the corresponding working cylinders (in the clockwise direction of rotation), so that in the radially inner circular series of holes the holes are following each other in the order of succession 1-2-4-6-5-3; whereas in the radially outer circular series of holes the holes are following each other according to the order of succession 7-8-10-12-11-9, in the aforesaid direction of rotation. There are moveover provided, for instance, three holes 20 of equal diameter having their respective centres uniformly distributed along a circle with a diameter of 50 mm, for instance, corresponding to a like circle extending through the centers of two respective radially re-entrant or recessed notches or indentations 21 formed in the inner edge of the recess 17 of the rotary disc 13. These openings 20 formed in the stationary distributor body 19 are in steady communication with the open outer atmosphere in order to enable the working cylinders involved to have their compressed air contents vented or exhausted through the agency of the common exhaust or drain recess 17 of the rotary disc 13.

FIG. 9 illustrates the application of the single rotary distributor shown in FIGS. 7 and 8 to the feeding of the starting valves of a V-type engine 22 having twelve working cylinders arranged in two rows of six working cylinders each, numbered 1 to 6, respectively, for the left-hand row and 7 to 12, respectively, for the right-hand row. It is thus seen that the radially inner port 15, with a normal or usual duration of opening would supply the left-hand row of working cylinders 1 to 6; whereas the radially outer port 16, with the shortened duration of opening, would feed the right-hand row of working cylinders 7 to 12.

FIG. 10 depicts the use of two separate rotary distributors 13′ and 13″, respectively, each adapted to feed a separate row of working cylinders, respectively, of the engine 22 while being each one driven by the cam-shaft associated with the row of working cylinders involved. In that instance the rotary disc of each distributor may have a smaller diameter than in the case of FIG. 9 and is formed with one single compressed air passage-way port only. Thus the rotary disc 13′ of the distributor feeding the left-hand row of working cylinders 1 to 6 is only provided with the long port 15 corresponding to a normal or usual duration of opening, for instance equivalent to an angle of crank-shaft rotation of the engine of about 148.5°, whereas the rotary disc 13″ of the distributor feeding the right-hand row of working cylinders 7 to 12 comprises a short port 16 corresponding to a duration of opening of compressed air passage-way equivalent to an angle of rotation of about 38°, for instance, of the crank-shaft of the engine 22. The stator of each distributor is then formed with one single circular series or ring of six stationary feed duct openings.

Alternatively, instead of a short port provided in the seating face of the distributor rotor and moving past identical round holes formed in the stationary bearing face of the distributor stator, it is possible, without departing from the scope of the invention, to provide an orifice of normal size in the rotary seating face and however to replace the identical round holes in the stationary stator bearing face respectively with orifices having differing sizes or circumferential curvilinear lengths respectively varying according to an inverse function with the distances of the associated working cylinders from the distributor; these variable orifices may in particular have the shapes of arcuate ports or lunules which will be smaller (i.e., will have each one a middle arc of circumference shorter) as the corresponding working cylinders are farther away from the distributor. With such relatively short orifices, variable (theoretical) durations of opening will also be obtained.

What is claimed is:

1. A method of improving the effectiveness of the pneumatic braking of a reversible diesel engine operating in particular on a four-stroke cycle, the engine having intake and exhaust valve means controlled by an engine-driven camshaft with forward running cams and reverse running cams, said camshaft being axially displaceable between an engine forward running position and an engine reverse running position, an even number of at least ten working cylinders arranged in particular in two V-shaped rows of a same number of working cylinders, at least some of which in each row are respectively provided with individual starting valves automatically closed by spring means after having been vented and the openings of which are pneumatically controlled sequentially by at least one central engine-driven rotary distributor, said closing being delayed in time with respect to the moment at which the order to close is delivered by shutting off the compressed air and by venting said distributor as an increasing function of the length of feed piping of each starting valve from said distributor and of the instant rotary speed of said engine, said method including reducing through constructional design of said distributor the relative duration of admission, through said distributor, of compressed pilot air for opening said starting valves in at least one row of working cylinders with respect to the duration for the other row thereby advancing the delivery of the order to close in such a manner that each starting valve involved closes not later than about the time at which the corresponding exhaust valve opens on the associated working cylinder, wherein the improvement comprises the steps of optimizing through constructional design of said distributor at least approximately the thus shortened value of the actual relative duration or control of opening of the compressed air passage-way at the distributor for each starting valve of one row of working cylinders intended for braking purposes with a view to increasing the instantaneous decreasing value of the rotary speed of the engine from which the braking step is initiated thereby advancing the moment at which the braking begins and of optimizing the duration for each starting valve of the other row of working cylinders for performing the starting step.

2. A method according to claim 1, comprising the step of determining a useful range of effective closing times for each starting valve during the braking period so that this closing actually takes place every time in particular before the opening of the intake or exhaust valves, respectively, on the corresponding working cylinder of said engine, within a range of relative angular positions of the crank-shaft about the top dead centre of the power piston in the associated working cylinder, which range is defined so as to always produce a positive braking torque or work at least equal to the required minimum effective torque whereas the optimum closing time which corresponds to the maximum braking torque is substantially that time at which the pressure within said working cylinder passes again, while decreasing during the expansion stroke, through the value of the available starting air pressure.

3. A method according to claim 2, wherein said useful range extends, for one aforesaid row of working cylinders the control of the starting valves of which is optimized for braking purposes, from a rotary speed of the engine equal to about 52% of the rated speed, corresponding with the time at which the braking step begins, to a rotary speed of about 16%, said optimum time corresponding to a rotary speed of about 40% whereas for the other aforesaid row of working cylinders said range extends from a rotary speed of about 24% to zero speed of said engine, said optimum time corresponding then to a rotary speed of about 12%.

4. A method according to claim 2, wherein with respect to said row of working cylinders, the control of the starting valves of which is optimized for braking purposes, the shortened relative duration of periodical compressed air flow through said distributor represents from about 20% to 50% of the corresponding duration for the other aforesaid row of working cylinders.

5. A method according to claim 4, wherein the relative duration of compressed air flow through said distributor for the other aforesaid row of working cylinders is equivalent to an angle of crank-shaft rotation of normal value of about 148.5° whereas the relative shortened duration for said one row of working cylinders is defined so that each time period of admission of compressed air for each working cylinder of said one row overlaps the separating time interval forming a transition region between the respective admission time periods for two homologous working cylinders of said one row which are successively fed with compressed air and wherein said relative shortened duration is equivalent to an angle of crank-shaft rotation of about from 30° to 60°.

6. A method according to claim 5, in particular applicable to a diesel engine with ten or twelve working cylinders and with an angular shift of about 128.5° of said rotary distributor upon change-over of the cams by axial displacement of the cam-shaft when reversing the engine and with a relative duration of compressed air-flow through said distributor equivalent to an angle of crank-shaft rotation of about 128.5° from its angular position of the top dead centre of the power piston for each starting valve of the other aforesaid row of working cylinders whereas each working cylinder of the one row is provided with a starting valve, wherein said duration is equivalent to an angle of crank-shaft rotation either of about 60°, beginning at about 5° after the angular position of the top dead centre during the starting period or at about 123.5° before said top dead centre during the braking period for the aforesaid one row of working cylinders which is optimized for braking purposes, or of about 40° for said one row with an engine having twelve working cylinders, beginning at about 25° after said angular position of the top dead centre during the starting period or at about 103.5° before said top dead centre during the braking period.

7. A method according to claim 5, in particular applicable to an engine having ten or twelve working cylinders with an angular shift of about 128.5° of said rotary distributor upon change-over of the cams by axial displacement of the cam-shaft when reversing the engine and with a relative duration of compressed air-flow through said distributor equivalent to an angle of crankshaft rotation of about 148.5° for each starting valve of the other aforesaid row of working cylinders, beginning at about 10° before its angular position of the top dead centre during the braking period, wherein for each working cylinder of said one row of working cylinders optimized for braking purposes said duration corresponds to an angle of crank-shaft rotation of about 40°, beginning either at about 15° after said angular position of the top dead centre during the starting period or at about 113.5° before said top dead centre during the braking period, or, with an engine having twelve cylinders, at about 5° after said angular position of the top dead centre during the starting period or at about 123.5° before the top dead centre during the braking period.

8. A method according to claim 5, applicable in particular to an engine having fourteen, sixteen or eighteen working cylinders with an angular shift of about 128.5° of said rotary distributor upon change-over of the cams by axial displacement of the camshaft when reversing the engine and with a relative duration of compressed air-flow through said distributor equivalent to an angle of crank-shaft rotation of about 128.5° for each starting valve of the other aforesaid row of working cylinders, wherein said other row of working cylinders is alone sufficient to perform the starting step whereas for said one row of working cylinders which is optimized for braking purposes those working cylinders which are remote from the associated distributor are devoid of any starting valve and said duration for each starting valve of said one row corresponds to an angle of crank-shaft rotation of about 40°.

9. A method according to claim 4, wherein the relative duration of compressed air flow through said distributor for the other aforesaid row of working cylinders is equivalent to an angle of crank-shaft rotation of about 128.5° whereas the relative shortened duration for the aforesaid one row of working cylinder is defined so that each time period of admission of compressed air for each working cylinder of said one row overlaps the separating time interval forming a transition region between the respective admission time periods for two homologous working cylinders of said one row which are successively fed with compressed air and wherein said relative shortened duration is equivalent to an angle of crank-shaft rotation of about from 30° to 60°.

10. A method according to claim 4, wherein the relative duration of compressed air flow through said distributor for the other aforesaid row of working cylinders is equivalent to an angle of crank-shaft rotation of about 110° whereas the relative shortened duration for the aforesaid one row of working cylinder is defined so that each time period of admission of compressed air for each working cylinder of said one row overlaps the separating time interval forming a transition region between the respective admission time periods for two homologous working cylinders of said one row which are successively fed with compressed air and wherein said relative shortened duration is equivalent to an angle of crank-shaft rotation of about from 30° to 60°.

* * * * *